US011224553B2

(12) United States Patent
Perry et al.

(10) Patent No.: US 11,224,553 B2
(45) Date of Patent: Jan. 18, 2022

(54) HAND REHABILITATION DEVICE

(71) Applicant: FUNDACIÓN TECNALIA RESEARCH & INNOVATION, Derio (ES)

(72) Inventors: Joel Perry, Derio (ES); Julius Klein, Derio (ES); Thierry Keller, Derio (ES)

(73) Assignee: FUNDACIÓN TECNALIA RESEARCH & INNOVATION, Derio (ES)

( * ) Notice: Subject to any disclaimer, the term of this patent is extended or adjusted under 35 U.S.C. 154(b) by 687 days.

(21) Appl. No.: 16/072,826

(22) PCT Filed: Jan. 27, 2017

(86) PCT No.: PCT/EP2017/051840

§ 371 (c)(1),
(2) Date: Jul. 25, 2018

(87) PCT Pub. No.: WO2017/129788

PCT Pub. Date: Aug. 3, 2017

(65) Prior Publication Data

US 2019/0029909 A1 Jan. 31, 2019

(30) Foreign Application Priority Data

Jan. 29, 2016 (EP) ..... 16382036

(51) Int. Cl.
*A61H 1/02* (2006.01)

(52) U.S. Cl.
CPC ... *A61H 1/0288* (2013.01); *A61H 2201/0153* (2013.01); *A61H 2201/1215* (2013.01);
(Continued)

(58) Field of Classification Search
CPC ..... A61H 1/02; A61H 1/0285; A61H 1/0288; A61H 2201/165
See application file for complete search history.

(56) References Cited

U.S. PATENT DOCUMENTS 4,576,148 A * 3/1986 Koerner ..... A61H 1/0288 482/901
4,644,938 A * 2/1987 Yates ..... A61H 1/0288 482/901

(Continued)

FOREIGN PATENT DOCUMENTS

CN 101897643 A 12/2010
CN 203494117 U 3/2014

(Continued)

OTHER PUBLICATIONS

International Search Report dated May 4, 2017 re Application No. PCT/EP2017/051840, pp. 1-3, citing: US 2010/305717 A1, CN 103 750 977 A, WO 2014/068509 A2 and WO 2015/024852 A1.

(Continued)

*Primary Examiner* — Rachel T Sippel
*Assistant Examiner* — Christopher E Miller
(74) *Attorney, Agent, or Firm* — Cantor Colburn LLP

(57) ABSTRACT

A hand rehabilitation device includes at least one support to support a thumb and to perform a flexion/extension movement for rehabilitating the thumb. The flexion/extension movement is actioned by a first transmission mechanism to which the support is connected. The device further includes another support to support the index finger and to perform a flexion/extension movement for rehabilitating the finger. The flexion/extension movement is actioned by a second transmission mechanism to which the at least one second support is connected. The device further includes another support for the three remaining fingers which is configured to perform a flexion/extension movement for rehabilitating the three remaining fingers. The flexion/extension movement is actioned by a third transmission mechanism to which the at least one third support is connected. The three transmission mechanisms are actuated by a motor; and the (Continued)

three flexion/extension movements of the three supports are independent from each other.

15 Claims, 24 Drawing Sheets

(52) U.S. Cl.
CPC .. *A61H 2201/1238* (2013.01); *A61H 2201/14* (2013.01); *A61H 2201/165* (2013.01); *A61H 2201/1635* (2013.01); *A61H 2201/1676* (2013.01)

(56) References Cited

U.S. PATENT DOCUMENTS

| | | | | | |
|---|---|---|---|---|---|
| 4,875,469 | A * | 10/1989 | Brook | A61H 1/0288 | 601/40 |
| RE33,182 | E * | 3/1990 | Pecheux | A61H 1/0288 | 601/40 |
| 5,516,249 | A | 5/1996 | Brimhall | | |
| 5,683,351 | A * | 11/1997 | Kaiser | A61H 1/0288 | 601/33 |
| 5,697,892 | A * | 12/1997 | Torgerson | A61H 1/0288 | 601/40 |
| 6,312,398 | B1 * | 11/2001 | Cencer | B64G 6/00 | 601/33 |
| 6,918,622 | B2 * | 7/2005 | Kim | B25J 15/10 | 294/106 |
| 8,574,178 | B2 | 11/2013 | Tong et al. | | |
| 2004/0082885 | A1 * | 4/2004 | Culhane | A61H 1/0277 | 601/5 |
| 2006/0106326 | A1 * | 5/2006 | Krebs | A61H 1/0274 | 601/40 |
| 2010/0305717 | A1 | 12/2010 | Tong et al. | | |
| 2012/0059290 | A1 * | 3/2012 | Yip | A61H 1/0288 | 601/40 |
| 2012/0059291 | A1 * | 3/2012 | Nguyen | A61H 1/0288 | 601/40 |
| 2013/0030327 | A1 * | 1/2013 | Zhang | A61H 1/0237 | 600/587 |
| 2013/0226350 | A1 * | 8/2013 | Bergelin | A61H 1/0288 | 700/275 |
| 2013/0261514 | A1 * | 10/2013 | Tsui | A61H 1/0288 | 601/40 |
| 2014/0277582 | A1 * | 9/2014 | Leuthardt | A61F 2/54 | 623/25 |
| 2015/0245972 | A1 * | 9/2015 | Arakawa | A61H 1/0288 | 601/40 |
| 2015/0342818 | A1 * | 12/2015 | Ikebe | A61H 1/0288 | 601/40 |
| 2015/0374575 | A1 * | 12/2015 | Kamper | A61H 1/0288 | 601/40 |
| 2017/0168565 | A1 * | 6/2017 | Cohen | A61B 5/0022 | |
| 2018/0177666 | A1 * | 6/2018 | Tsui | A61F 5/013 | |
| 2019/0151181 | A1 * | 5/2019 | Lince | A61H 1/0288 | |

FOREIGN PATENT DOCUMENTS

| | | | |
|---|---|---|---|
| CN | 104383660 | A | 3/2015 |
| WO | 2010140984 | A1 | 12/2010 |
| WO | 2013086023 | A1 | 6/2013 |
| WO | 2014068509 | A2 | 10/2013 |
| WO | 2015024852 | A1 | 2/2015 |
| WO | 2016012480 | A1 | 1/2016 |

OTHER PUBLICATIONS

Written Opinion dated May 4, 2017 re Application No. PCT/EP2017/051840, pp. 1-6, citing: US 2010/305717 A1, CN 103 750 977 A, WO 2014/068509 A2 and WO 2015/024852 A1.

* cited by examiner

HAND REHABILITATION DEVICE

TECHNICAL FIELD

The present disclosure relates to the field of devices for rehabilitation of impaired limbs and, in particular, to devices for rehabilitation of impaired hands and fingers.

BACKGROUND

Finger function can be lost or damaged as a result of neurological injuries, such as stroke, spinal cord injuries, traumatic brain injuries or Parkinson disease. For example, stroke may cause paralysis of one side of the body. Examples of damaged finger functions are failure to extend fingers, poor finger coordination, loss of finger independence, poor grasping or manipulation ability and inability to control constant grip force. Since the brain has certain capacity to reorganize the damaged neural connections, a partial (or even complete) recovery of the damaged functions is possible.

There exist active apparatuses for hand rehabilitation, including finger rehabilitation. Such rehabilitation aims at stimulating the recovery, usually by performing repeated movements involving the impaired limb.

One well-known type of hand rehabilitation systems is based on exoskeletons, which are robotic skeletons that externally embrace a limb or part of the body. For example, U.S. Pat. No. 5,516,249-A describes an exoskeletal control apparatus based on a glove framework into which a hand can be inserted. A similar system is disclosed in U.S. Pat. No. 8,574,178-B2. This type of devices is complex because they have a lot of moving parts, which results in expensive maintenance. Besides, they require long time to fit a patient's hand to the device.

There are also less-complex finger rehabilitation systems, such as the one disclosed in International patent application WO-2010/140984-A1, which comprises a support on which an impaired arm is fixed and five sub-systems, each of them comprising a finger fixation (strap) and a clutch system. Each finger strap is actuated by means of a cable (guided through a pulley) pulling in one direction and a bow spring in the other. However, this system is hardly portable due to its non-compactness. Besides, a force is applied on each finger fixation and is therefore concentrated on a finger joint, therefore causing a potential damage on the joint and not optimizing the finger function rehabilitation. Additionally, finger flexion is provided exclusively by the bow spring component, not the motor, which makes the applied control to the fingers harder to control.

Finally, the availability of simple low-cost devices could extend the duration of rehabilitation, allowing robot-supported exercises at the patient's home, under remote monitoring and/or evaluation by the therapists. International patent application number WO2015/024852A1 discloses a hand motion exercising device having a movement unit dedicated to the thumb and a movement unit dedicated to the fingers. Both movement units are driven by a single motor. Besides, conventional hand rehabilitation devices, including the one disclosed in WO2015/024852A1, are designed to be used with either a right hand or a left hand, which results in requiring high investment.

Therefore, there is a need to provide a finger function rehabilitation device which has a simple portable structure and, at the same time, permits an optimized rehabilitation of the five fingers of both a right hand and a left hand.

SUMMARY

The disclosure provides a portable modular device for hand rehabilitation. The different functions of the different fingers are optimized with the proposed device, because it permits independent rehabilitation (functional flexion/extension) of thumb and index finger, involved in most types of grasping. The remaining fingers—middle, ring and little fingers—are simultaneously moved in a single group. The proposed device, which is a hand-held device, mobilizes fingers by constraining fingertips along their natural, stereotypical trajectory for grasping tasks.

According to an aspect of the present disclosure, a device is provided for a hand rehabilitation device that comprises: at least one first support configured to support the thumb of a hand, wherein said at least one first support is designed to perform a flexion/extension movement for rehabilitating said thumb, said flexion/extension movement being actioned by a first transmission mechanism to which the at least one first support is connected; at least one second support configured to support the index finger of said hand, wherein said at least one second support is designed to perform a flexion/extension movement for rehabilitating said index finger, said flexion/extension movement being actioned by a second transmission mechanism to which the at least one second support is connected; at least one third support configured to support the three remaining fingers—middle ring, and little fingers—of said hand, wherein said at least one third support is designed to perform a flexion/extension movement for rehabilitating said three remaining fingers, said flexion/extension movement being actioned by a third transmission mechanism to which the at least one third support is connected; wherein said first transmission mechanism is actuated by one motor different from the at least one motor configured to actuate said second and third transmission mechanisms; wherein the three flexion/extension movements of said at least one first support, said at least one second support and said at least one third support are independent from each other.

In a particular embodiment, at least one of said first, second and third transmission mechanisms comprises a pinion and a crown configured to move actioned by said pinion, which in turn is configured to rotate actioned by said motor. Still more particularly, upon rotation, said crown is configured to pull two crown gears interconnected by respective protrusions or teeth, causing said supports to move in flexion/extension way. Alternatively, upon rotation, said crown is configured to pull an assembly formed by two wheels and coupling means connecting said two wheels together, wherein the wheel closest to the pinion is fixed and the other wheel and the coupling means move as a result of the movement of the crown.

In a particular embodiment, said at least one second support comprises a single support for the index finger and said at least one third support comprises a single support for the three remaining fingers—middle ring, and little fingers.

In a particular embodiment, said at least one second support comprises one distal support for the distal phalanx of the index finger and one proximal support for the intermediate phalanx of the index finger, and said at least one third support comprises one distal support for the distal phalanx of the three remaining fingers—middle ring, and little fingers and one proximal support for the intermediate phalanx of the three remaining fingers—middle ring, and little fingers. Preferably, said at least one first support, said one distal support for the distal phalanx of the index finger and said one distal support for the distal phalanx of the three remaining fingers—middle ring, and little fingers—are coupled to the movable wheel of respective transmission mechanisms by means of a part that attaches to a pivot in the respective transmission mechanism.

In a particular embodiment, said at least one first support, said at least one second support and said at least one third support are coupled to respective transmission mechanisms by means of a part that attaches to a pivot in the respective transmission mechanism.

In a particular embodiment, the device is reversible and therefore a same device serves at rehabilitating a right hand and a left hand. The device includes a reversible means configured to adjust the device between a right hand configuration and a left hand configuration: either by moving freely a set formed by a support and a part with respect to a pivoting means, when the transmission mechanism comprises two crown gears interconnected by respective protrusions or teeth; or by lifting pins and turning wheels until the corresponding pin naturally locks into a position in the opposite end of a canal and by moving freely a set formed by a support and a part with respect to a pivoting means, when the transmission mechanism comprises two wheels and coupling means connecting said two wheels together.

In a particular embodiment each one of said first, second and third transmission mechanisms is actuated by one corresponding motor.

The disclosure also provides a portable modular device for hand rehabilitation configured for rehabilitation of at least the index, middle, ring and little fingers in two sections: a first section for the lower (proximal) phalanx and the intermediate phalanx of each finger; and a second section for the upper (distal) phalanx of each finger. With this double movement (movement in two sections) the flexion/extension of each finger is performed in a natural way, without forcing the joints.

According to another aspect of the present disclosure, a hand rehabilitation device is provided, that comprises: at least one first support configured to support the thumb of a hand, wherein said at least one first support is designed to perform a flexion/extension movement for rehabilitating said thumb, said flexion/extension movement being actioned by a first transmission mechanism to which the at least one first support is connected; at least one proximal support configured to support the intermediate phalanx of at least the middle, ring and little fingers of said hand, wherein said at least one proximal support is designed to perform a flexion/extension movement of said intermediate phalanxes of said fingers, actioned by at least one second transmission mechanism to which the at least one proximal support is connected; at least one distal support configured to support the distal phalanx of at least the middle, ring and little fingers of said hand, wherein said at least one distal support is designed to perform an additional flexion/extension movement of said distal phalanxes of said fingers with respect to the flexion/extension movement of said intermediate phalanxes of said fingers, actioned by said at least one second transmission mechanism to which the at least one distal support is connected; wherein said first transmission mechanism is actuated by one motor different from the at least one motor configured to actuate said at least one second transmission mechanisms; wherein the flexion/extension movement of said at least one first support is independent from the flexion/extension movements of said at least one proximal support and at least one distal support.

In a particular embodiment, at least one of said first and transmission mechanisms comprises a pinion and a crown configured to move actioned by said pinion, which in turn is configured to rotate actioned by said motor. Still more particularly, upon rotation, said crown is configured to pull two crown gears interconnected by respective protrusions or teeth, causing said supports to move in flexion/extension way. Alternatively, upon rotation, said crown is configured to pull an assembly formed by two wheels and coupling means connecting said two wheels together, wherein the wheel closest to the pinion is fixed and the other wheel and the coupling means move as a result of the movement of the crown.

In a particular embodiment, said at least one proximal support comprises a single support for the intermediate phalanxes of said index, middle, ring and little fingers and said at least one distal support comprises a single support for the distal phalanxes of said index, middle, ring and little fingers.

In a particular embodiment, said at least one first support and said at least one proximal support are coupled to respective transmission mechanisms by means of a part that attaches to a pivot in the respective transmission mechanism and said at least one distal support are coupled to respective transmission mechanisms by means of a part that attaches to a pivot in the respective transmission mechanism.

In a particular embodiment, said at least one proximal support comprises a first support for the intermediate phalanx of said index finger and a second support for the intermediate phalanx of said middle, ring and little fingers; and said at least one distal support comprises a third support for the distal phalanx of said index finger and a fourth support for the distal phalanxes of said middle, ring and little fingers. Preferably, the device further comprises one transmission mechanism for actuating said first proximal support for the intermediate phalanx of the index finger and said third distal support for the distal phalanx of the index finger and another transmission mechanism for actuating said second proximal support for the intermediate phalanx of the middle, ring and little fingers and said fourth distal support for the distal phalanx of the middle, ring and little fingers.

In a particular embodiment, the device is reversible and therefore a same device serves at rehabilitating a right hand and a left hand. The device is reversible: either by moving freely a set formed by a support and a part with respect to a pivoting means, when the transmission mechanism comprises two crown gears interconnected by respective protrusions or teeth; or by lifting pins and turning wheels until the corresponding pin naturally locks into a position in the opposite end of a canal and by moving freely a set formed by a support and a part with respect to a pivoting means, when the transmission mechanism comprises two wheels and coupling means connecting said two wheels together.

In a particular embodiment, each one of said at least two transmission mechanisms is actuated by one corresponding motor.

Additional advantages and features of the disclosure will become apparent from the detail description that follows and will be particularly pointed out in the appended claims.

BRIEF DESCRIPTION OF THE DRAWINGS

To complete the description and in order to provide a better understanding of the disclosure, a set of drawings is provided. Said drawings form an integral part of the description and illustrate an embodiment of the disclosure, which should not be interpreted as restricting the scope of the disclosure, but just as an example of how the disclosure can be carried out. In the figures:

In FIGS. 9A-9C, the flexion/extension mechanism for the finger support is configured for rehabilitating a right hand. In FIGS. 9D-9F it is configured for rehabilitating a left hand.

FIGS. 10D-10F left hand).

FIGS. 13A and 13C show the left hand configuration, while FIGS. 13B and 13D show the corresponding right hand configuration.

In the context of the present disclosure, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

The following description is not to be taken in a limiting sense but is given solely for the purpose of describing the broad principles of the disclosure. Next embodiments of the disclosure will be described by way of example, with reference to the above-mentioned drawings showing apparatuses and results according to the disclosure.

DETAILED DESCRIPTION OF THE DRAWINGS

FIGS. 1, 2A, 2B, 3A, 3B and 3C show different views of a hand rehabilitation device 100 according to a possible embodiment of the disclosure. The device 100 is versatile, meaning that it can be configured for rehabilitating either a right hand or a left hand. The configuration shown in these figures is a right-hand configuration, but it can simply be switched to a left-hand configuration, as will be explained later in this text. The device 100 can be attached to another device or apparatus, such as to a tool robot, a manipulator or an arm support (for example a support fixed on a table), or directly to the arm of the user. It can also act as a hand-held device.

Figure 2A:
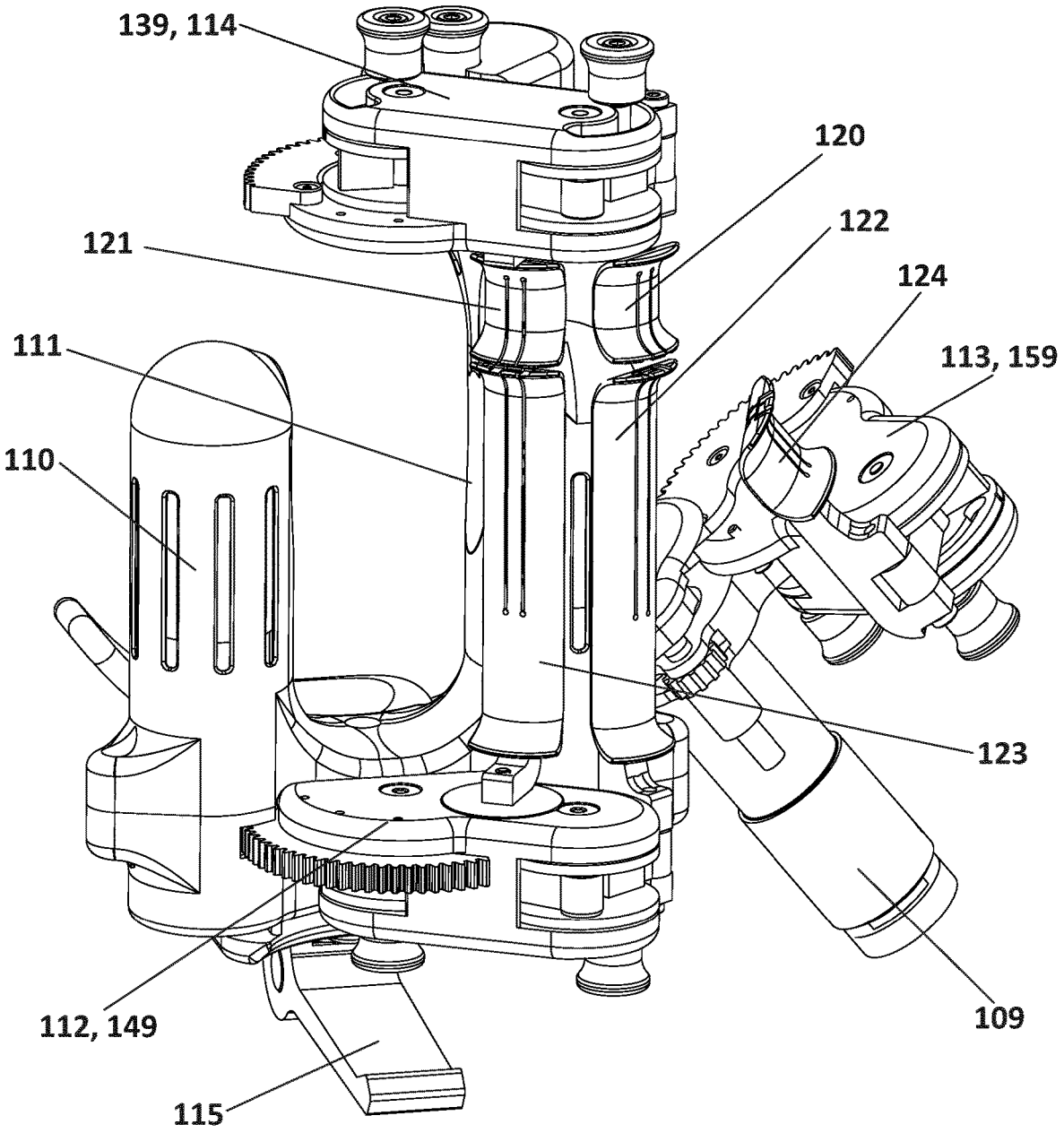
FIG. 2A shows a different view of the hand rehabilitation device of FIG. 1.
Figure 2B:
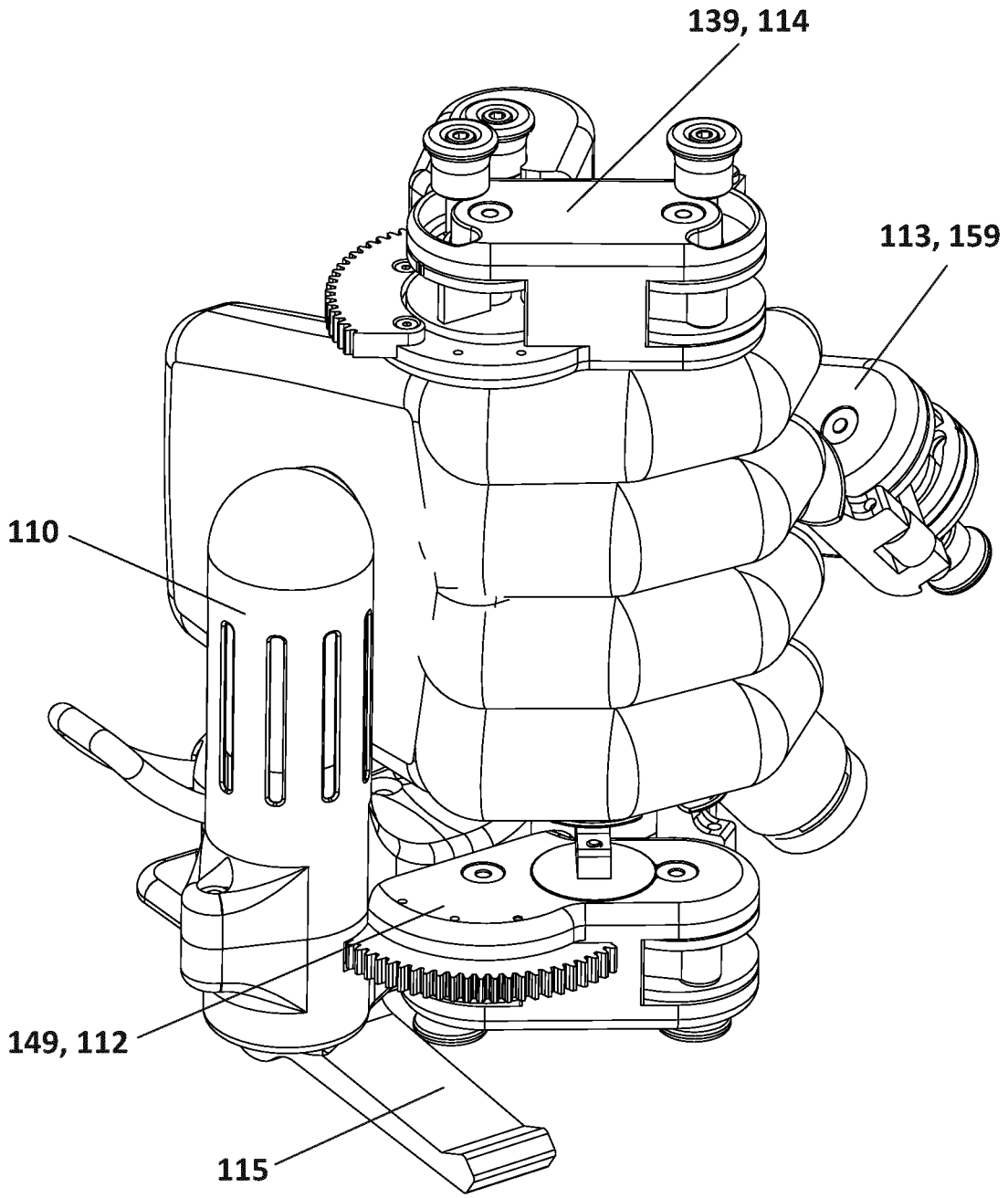
FIG. 2B shows the same view as shown in FIG. 2A, of the hand rehabilitation device, wherein a right hand in its functional position has been illustrated.
Figure 3A:
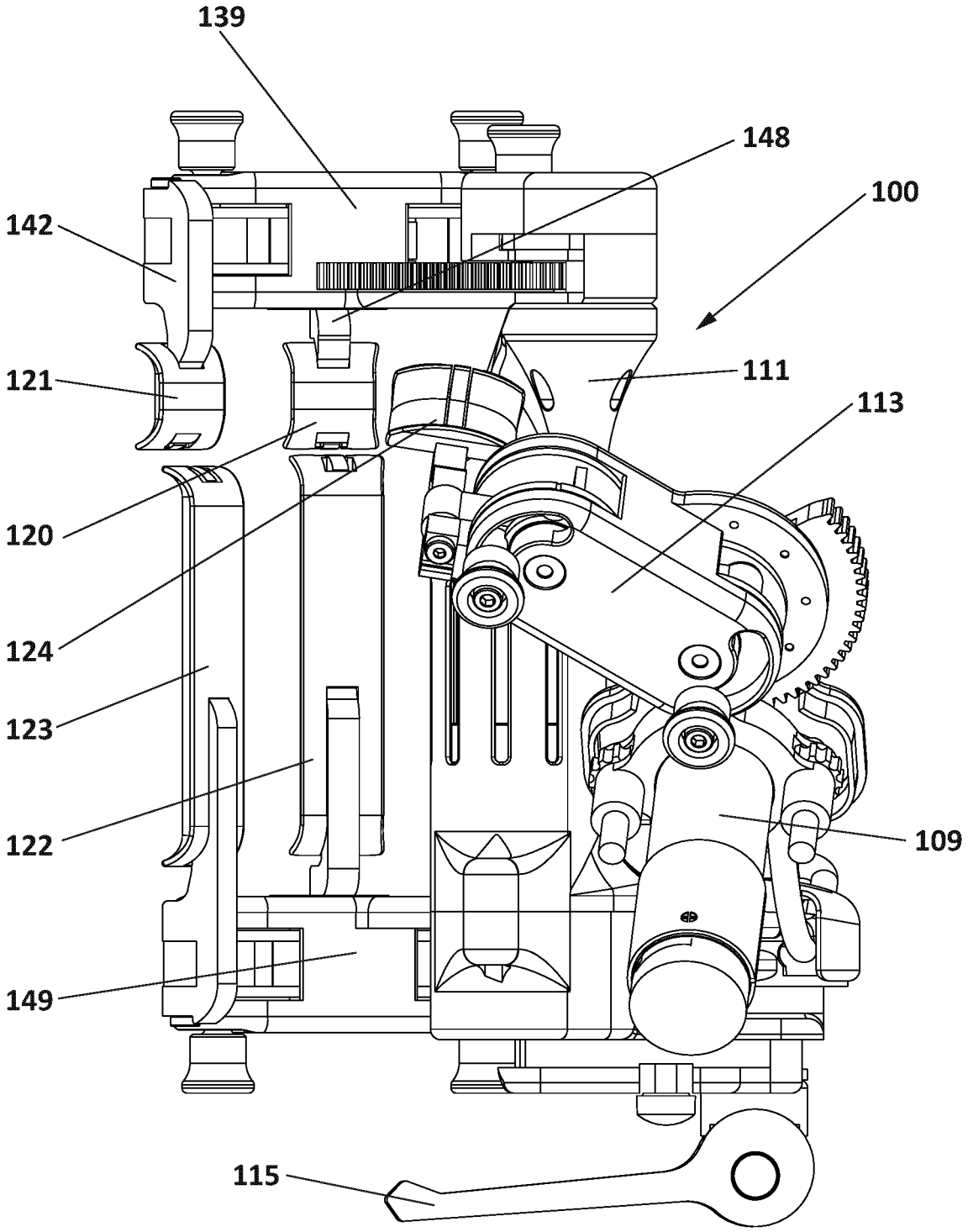
FIGS. 3A and 3B show different views of the hand rehabilitation device of FIG. 1.
Figure 3B:
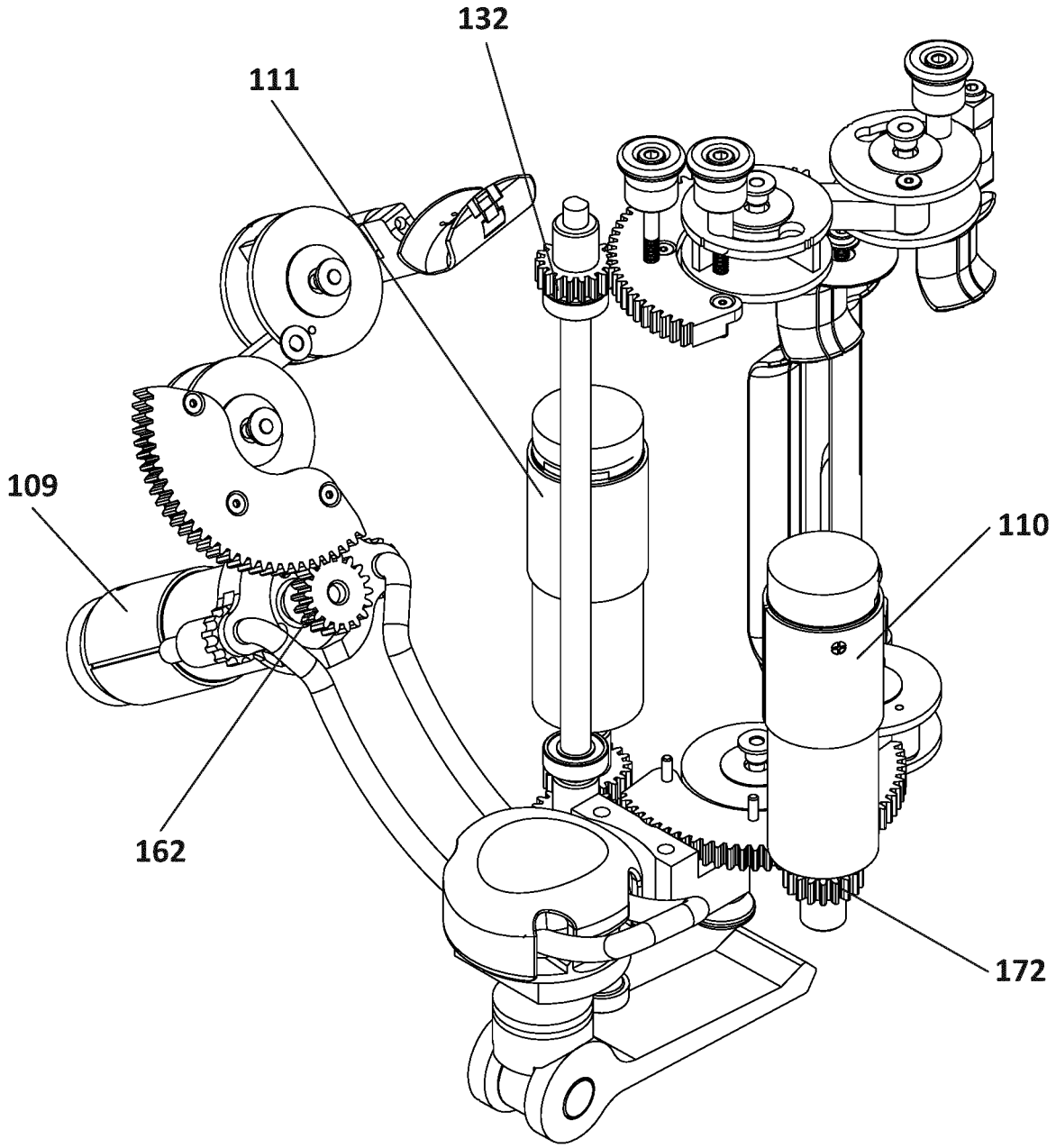
Figure 3C:
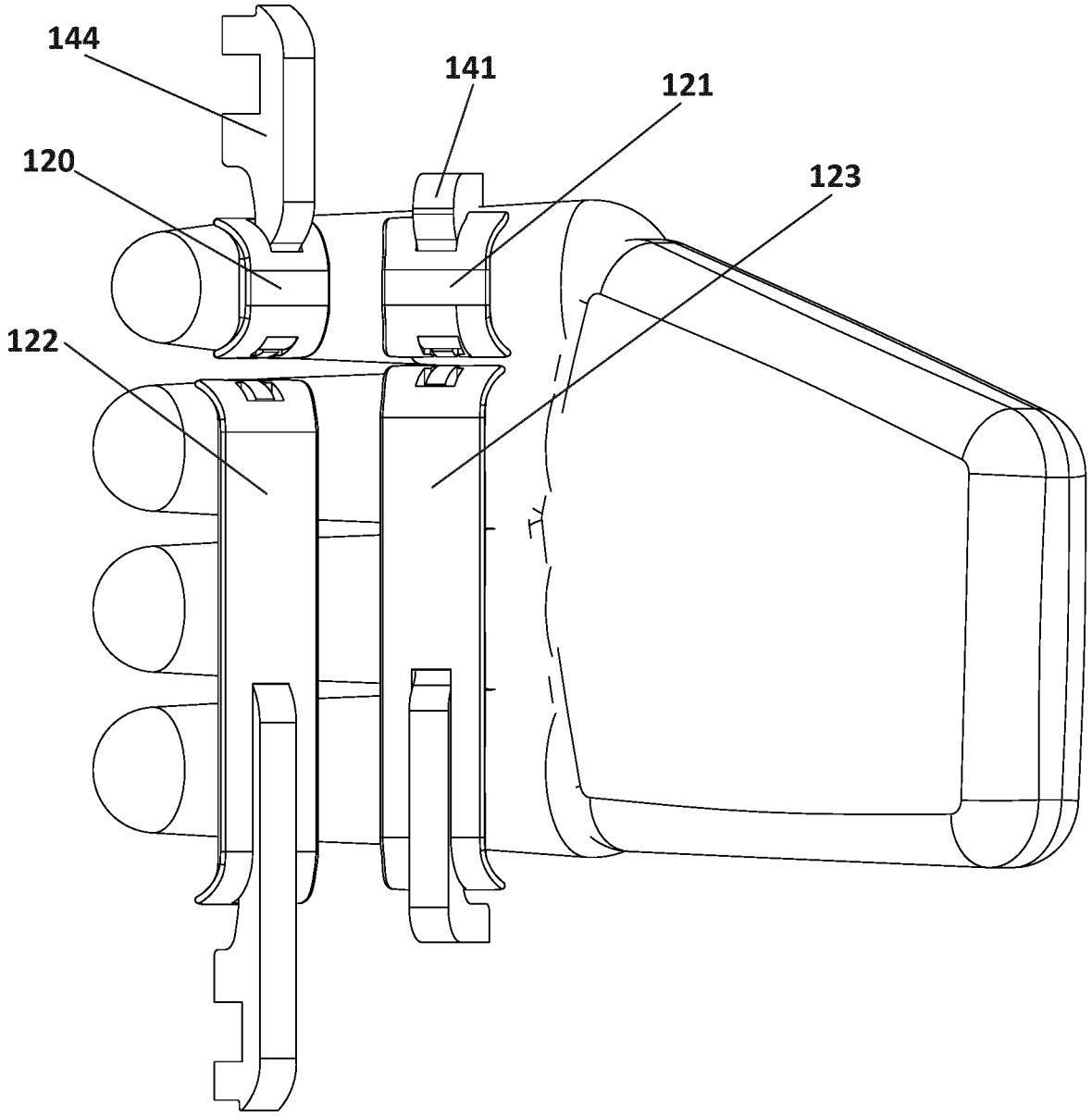
FIG. 3C shows in detail the finger supports for the four fingers (hand rehabilitation device of FIG. 1).
Figure 4A:
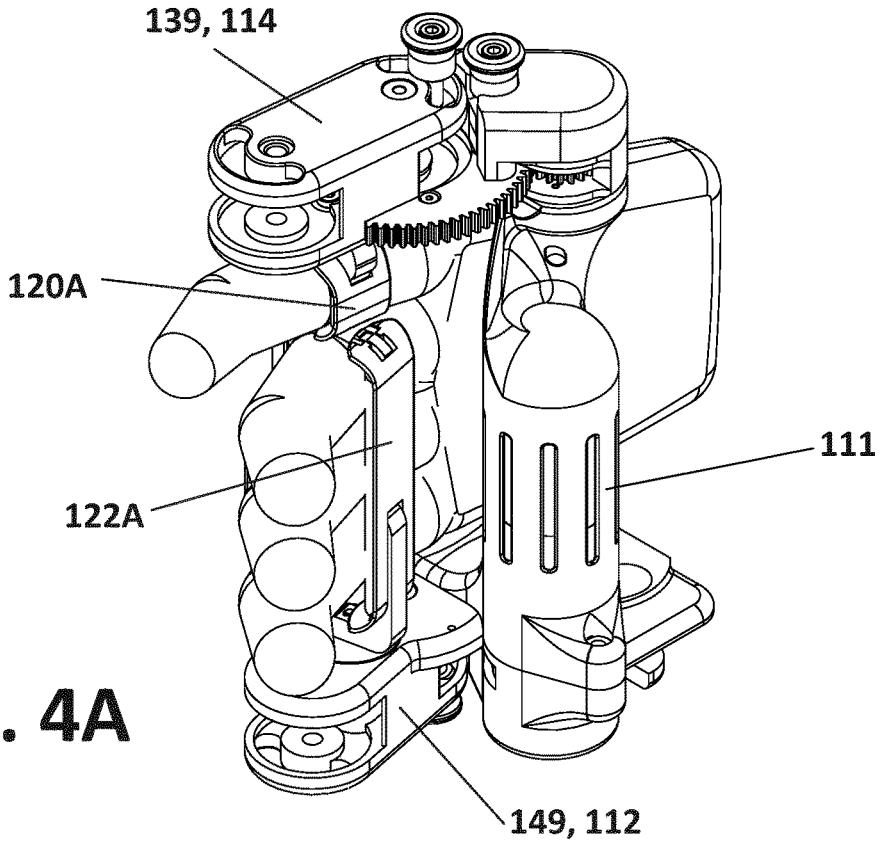
FIGS. 4A-4D show different views of a hand rehabilitation device according to a more general embodiment of the disclosure. In this embodiment, there is a single finger rest for the index finger and a single finger rest for the group of fingers formed by middle, ring and little fingers.
Figure 4B:
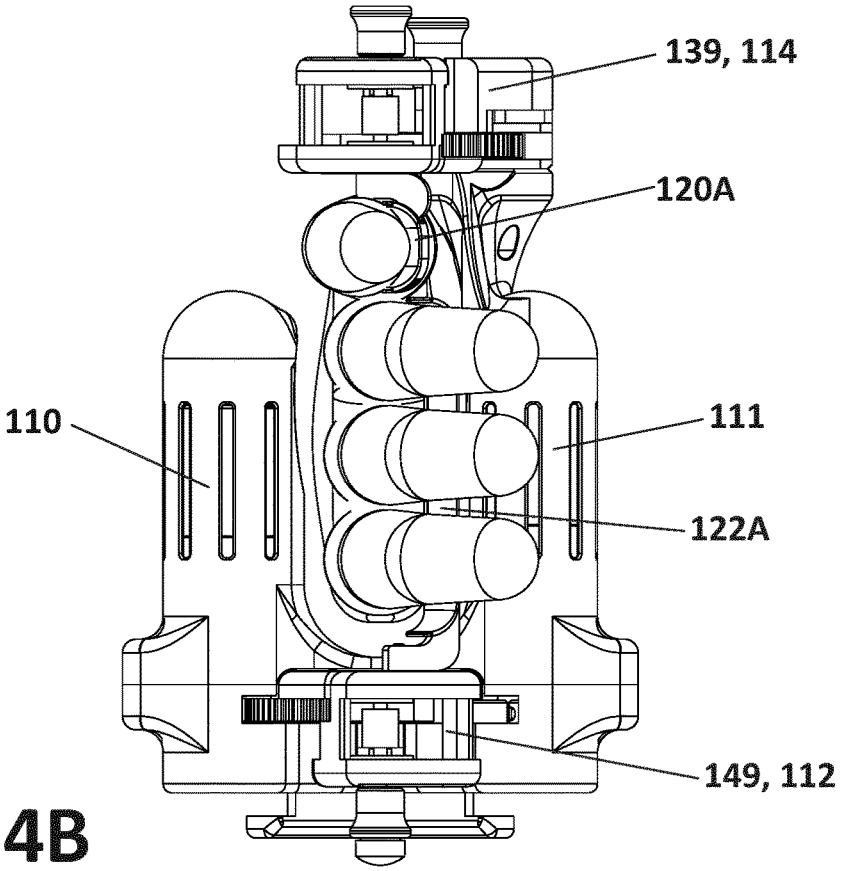
Figure 4C:
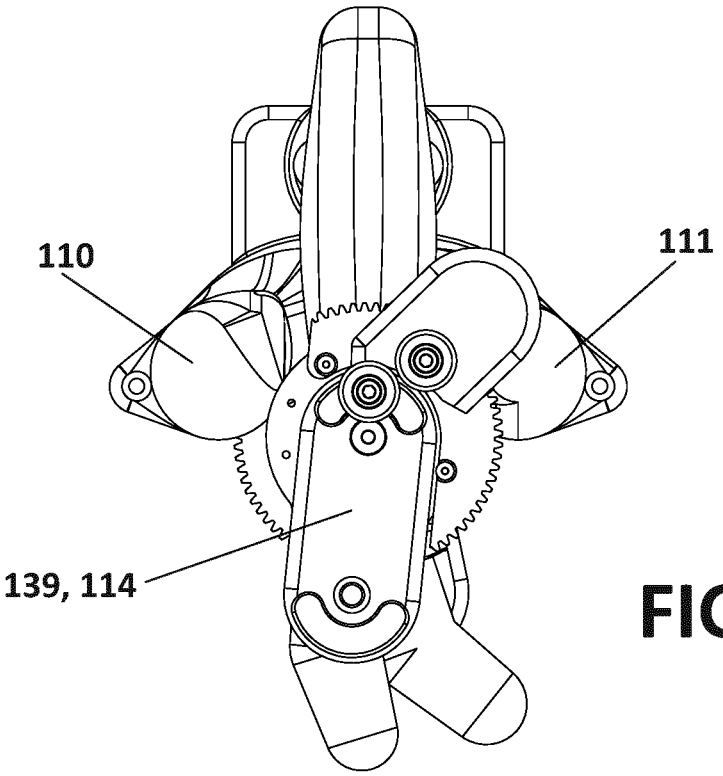
Figure 4D:
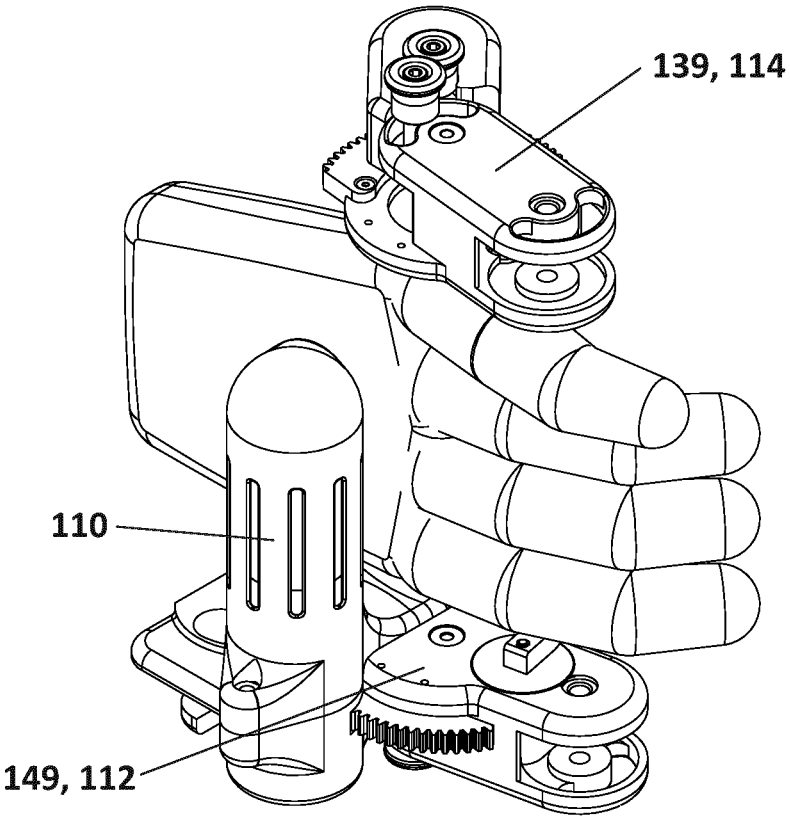
Figure 4E:
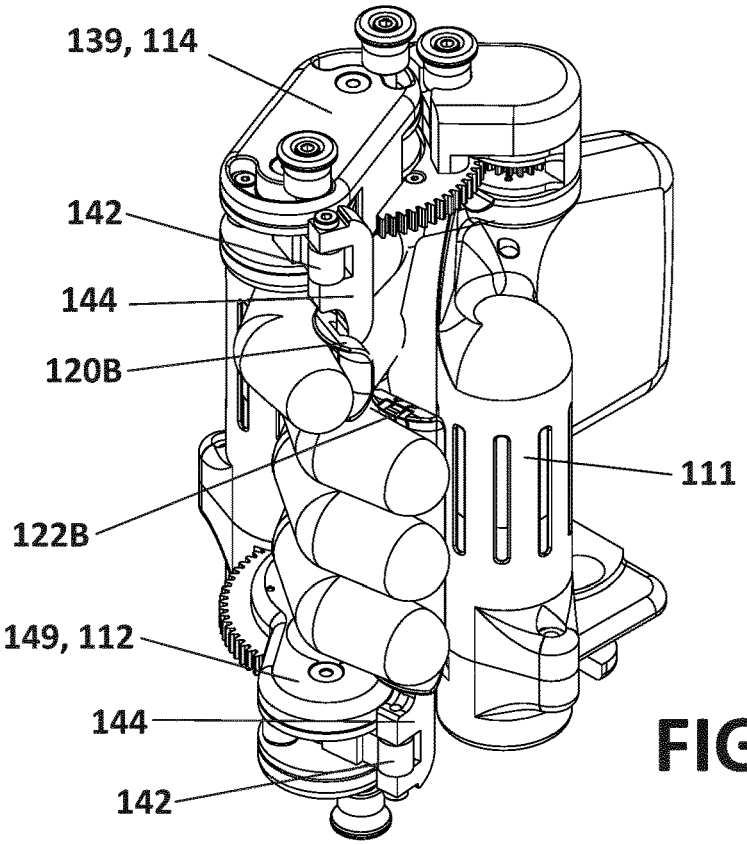
FIGS. 4E to 4H show an alternative implementation of this more general embodiment.
Figure 4F:
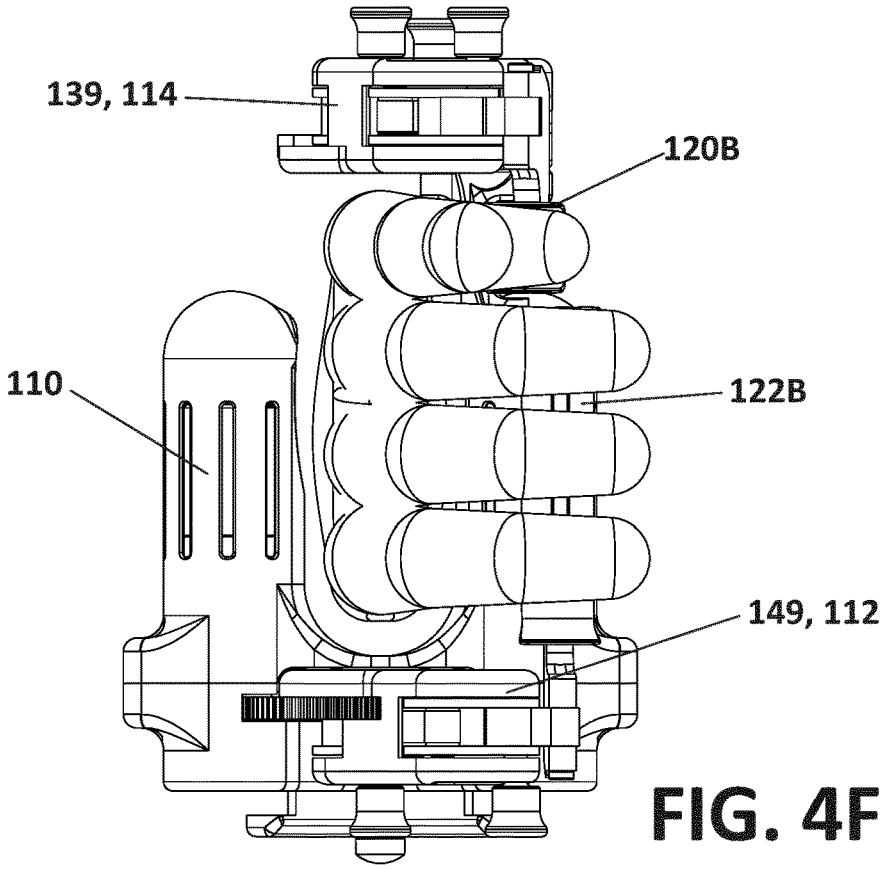
Figure 4G:
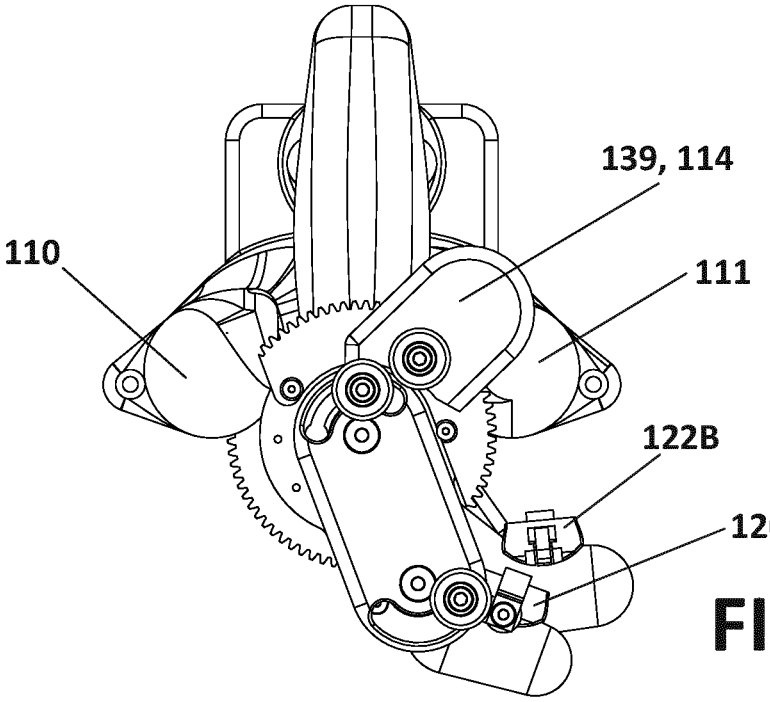
Figure 4H:
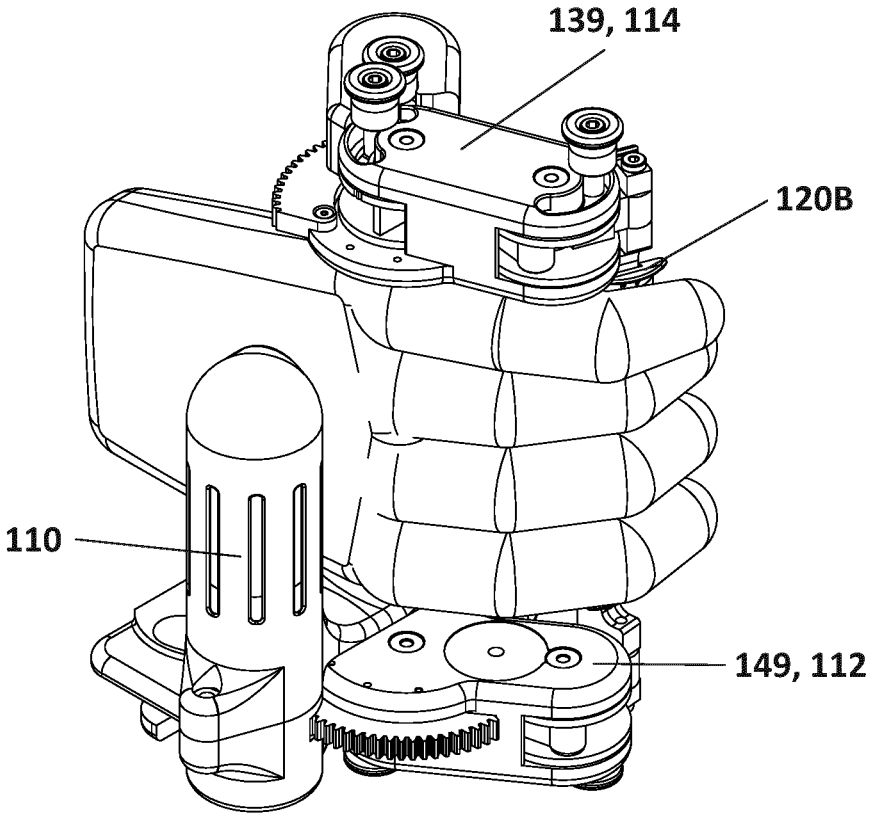

The portable device 100 is configured to be grasped by the hand to be trained, in such a way that the palm, fingers and thumb (inner part of the hand) surround the grasped device 100. In this particular implementation, the structure 110 is to be grasped by a right-hand, as shown in FIG. 2B. When grasping the hand-held device 100 by an impaired hand, the inner part of the fingers and thumb are disposed on several supports or "finger rests" 120 121 122 123 124 disposed to receive the fingers and thumb, which rest or are supported on the supports. Optionally, a strap can be included, in order to ensure that the fingers are attached to the device. The strap can be especially useful for finger flexion (hand closing movement). In the shown embodiment, two finger rests 120 121 are disposed for receiving the respective distal phalanx and at least a portion of the intermediate phalanx (or the whole intermediate phalanx) of the index finger (inner part thereof) and two finger rests 122 123 are disposed for receiving the respective distal phalanx and at least a portion of the intermediate phalanx (or the whole intermediate phalanx) of another group of fingers, formed by middle, ring and little fingers (inner part thereof). In other words, the two upper finger rests 120 122 end up between the distal and the intermediate phalanx of the index finger and middle, ring and little fingers, respectively, while the two lower finger rests 121 123 end up between the proximal and the intermediate phalanx of the index finger and middle, ring and little fingers, respectively. As shown for example in FIG. 3A, the supports or rests 120 121 for the index finger are attached to a structure (carriage) 139, which holds the transmission mechanism 114 for those rests 120 121. FIG. 3C shows the attaching means 144 141 for supports 120 121, respectively. Similarly, the supports or rests 122 123 for the middle, ring and little fingers are attached to a structure (carriage) 149 which holds the transmission mechanism 112 for those rests 122 123. The view of FIG. 1 and the rotated view of FIG. 3A show an additional support or rest 124 for the thumb. The disposition of this thumb rest 124 with respect to the other finger rests has been selected to be adapted to the natural shape of the hand. The support or rest 124 for the thumb is attached to a structure (carriage) 159 which holds the transmission mechanism 113 for that rest 124. In the figures, other elements can be observed, such as: a motor 110 for actuating the supports or rests 122 123 for the middle, ring and little fingers (the casing of this motor 110 functions as a palm rest for a left hand or as a grasp for the device with a left hand when the device is used for rehabilitating a left hand); a motor 111 for actuating the supports or rests 120 121 for the index finger (the casing of this motor 111 functions as a palm rest for a right hand or as a grasp for the device with a right hand when the device is used for rehabilitating a right hand); a motor 109 for actuating the support or rest 124 for the thumb; a transmission mechanism 112 (held in carriage 149) associated to motor 110; a transmission mechanism 113 (held in carriage 159) associated to motor 109; a transmission mechanism 114 (held in carriage 139) associated to motor 111; and a locking arm 115 for a thumb adjustment mechanism.

FIGS. 4A-4D show a more general embodiment, in which there is a single finger rest 120A for the index finger and a single finger rest 122A for the group of fingers formed by middle, ring and little fingers. In this case, finger rest 120A ends up between the proximal and the intermediate phalanx of the index finger, while finger rest 122A ends up between the proximal and the intermediate phalanx of the middle, ring and little fingers. In these views the thumb and corresponding rehabilitation mechanism have been removed for clarity purposes.

FIGS. 4E-4H show an alternative implementation of the more general embodiment, in which there is a single finger rest 120B for the index finger and a single finger rest 122B for the group of fingers formed by middle, ring and little fingers. In this case, finger rest 120B ends up between the intermediate and the distal phalanx of the index finger, while finger rest 122B ends up between the intermediate and the distal phalanx of the middle, ring and little fingers. In these views the thumb and corresponding rehabilitation mechanism have also been removed for clarity purposes.

As will be explained later, in use of the device, the supports or finger rests 120 121 120A 120B 122 123 122A 122B 124 are moved, actuated by motors 111 110 109, provoking the flexion/extension of the fingers (and thumb) supported on the corresponding finger rests. As can be observed, the device 100 permits independent rehabilitation of the thumb (by means of rest 124 (see for example FIG. 3A)) and independent rehabilitation of the index finger (by means of finger rest 120A (FIGS. 4A-4D) or by means of finger rest 120B (FIGS. 4E-4H) or by means of finger rests 120 121 (FIGS. 1-3C)) with respect to the three remaining fingers, which are rehabilitated in a single group (either on finger rest 122A or on finger rest 122B or on finger rests 122 123). Thus, the device permits independent rehabilitation (functional flexion/extension) of thumb and index finger, these fingers being the ones involved in most types of grasping movements. The remaining fingers—middle, ring and little fingers—are simultaneously moved in a single group. The device 100 permits passive rotation of finger supports (finer rests) for self-alignment with hands of varying sizes.

Next, the transmission mechanism 113 112 114 which enables the flexion/extension of the thumb and fingers is explained. Each transmission mechanism 112 113 114 is actuated by a motor 110 109 111. The illustrated embodiments show an independent transmission mechanism 113 for the thumb, an independent transmission mechanism 114 for the index and an independent transmission mechanism 112 for the three fingers. In an alternative embodiment, here is an independent transmission mechanism 113 for the thumb and one single additional independent transmission mechanism for the four fingers. This is achieved by connecting or locking, for example by means of a bar, rest 120A with rest 122A in FIG. 4A, or rest 120B with rest 122B in FIG. 4E, or rest 120 with rest 122 and rest 121 with rest 123 in FIG. 3A or FIG. 3C. In any of these cases, one of the two motors (motor 111 or motor 110) could be removed. In the particular embodiment in which there is independent rehabilitation of the index finger, there are two independent transmission mechanisms (instead of one): one independent transmission mechanism 114 for the index finger and one independent transmission mechanism 112 for the three remaining fingers. The functioning of the several transmission mechanisms is the same and is described next. Next, two possible embodiments for the transmission mechanism 112 113 114 are described with reference to respective FIGS. 6 and 7. Both embodiments comprise a double gearwheel mechanism 130 131 and are equivalent within the range of motion (ROM) of interest. FIGS. 9A-9F show several positions of the mechanism of the flexion/extension of the fingers (in this case implemented as shown in FIG. 7).

Figure 6:
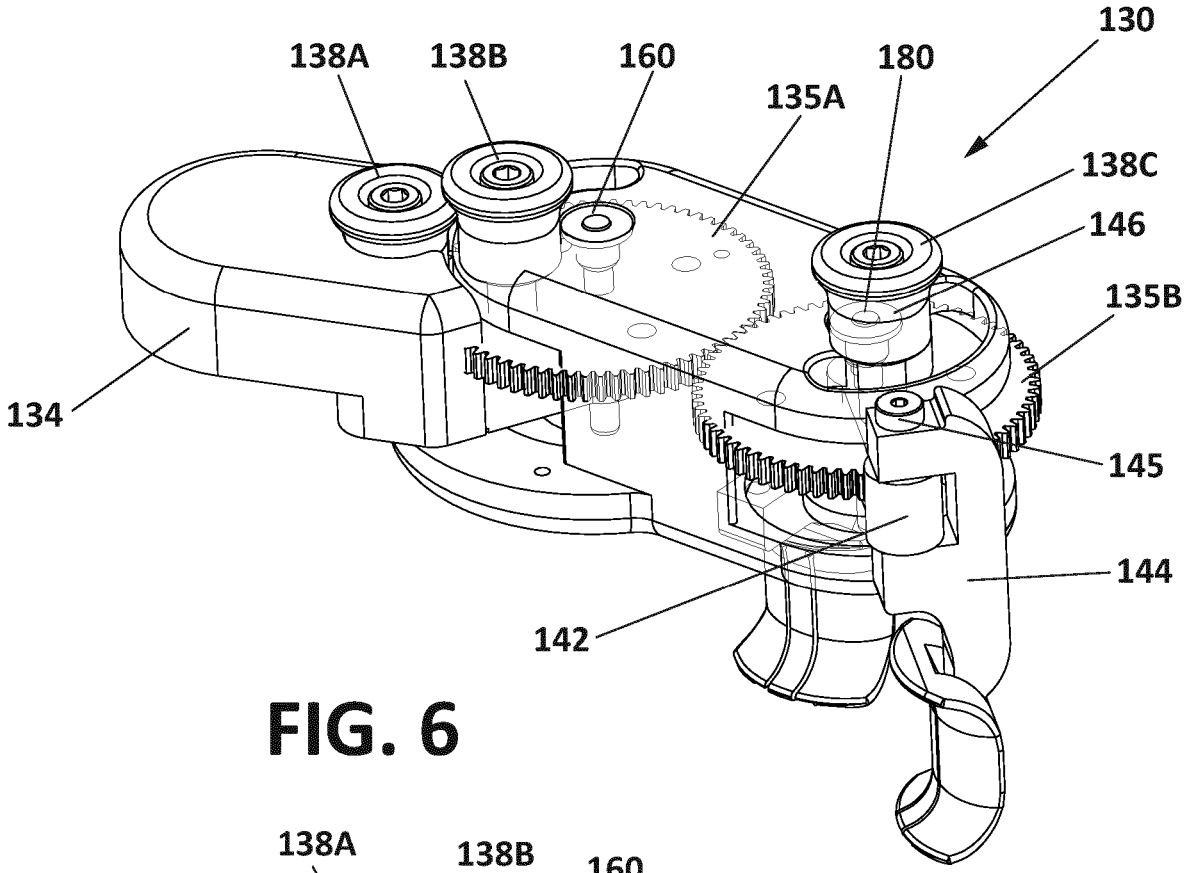
FIG. 6 shows a transmission mechanism according to a possible embodiment of the disclosure.
Figure 7:
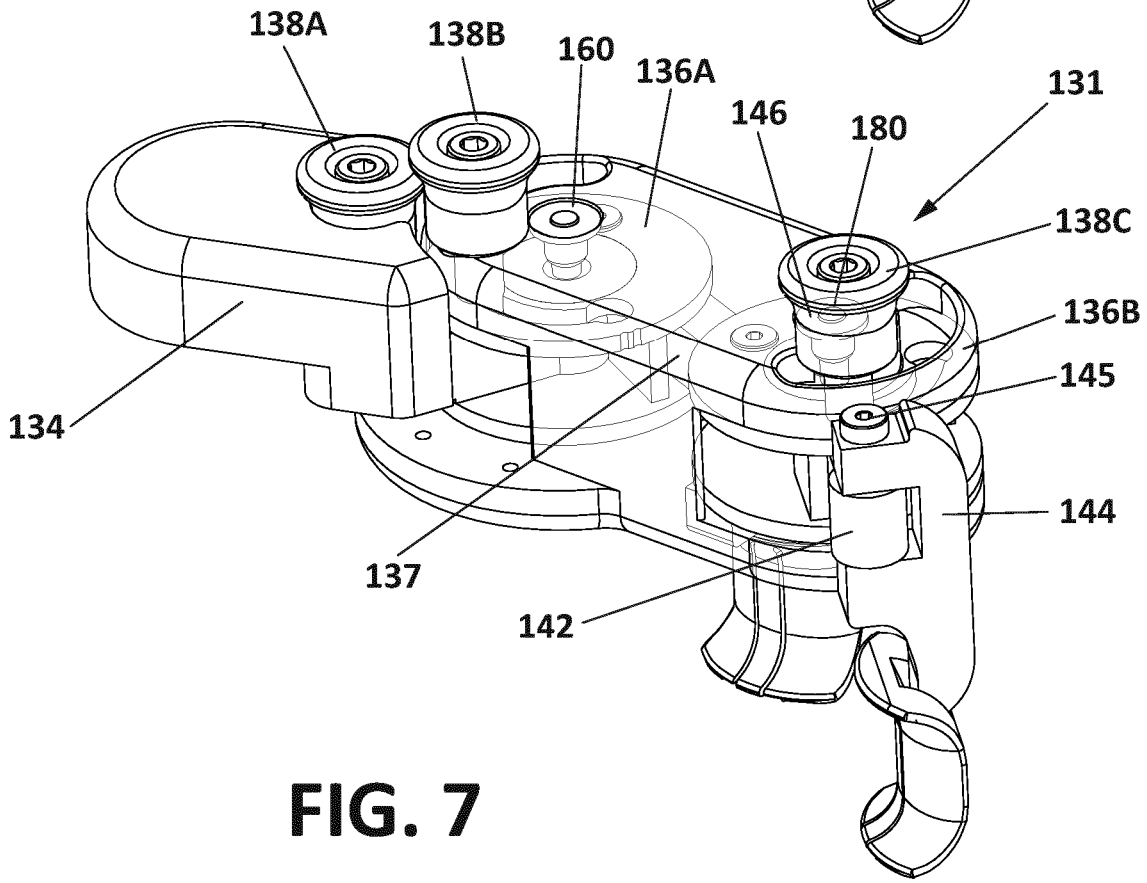
FIG. 7 shows a transmission mechanism according to an alternative embodiment of the disclosure.

FIGS. 6 and 7 show two possible embodiments of the double gearwheel mechanism 130 131. The double gearwheel mechanism 130 in FIG. 6 is based on a double toothed gearwheel. The double gearwheel mechanism 131 in FIG. 7 is based on a double wheel with mechanical coupling. In both implementations 130 131 of the mechanism, a respective motor 111 110 109, not shown in FIGS. 6 and 7, actuates on a pinion 132, which is rotated by the motor. The pinion 132 in turn makes a crown 133 move (the crown 133 is shown in FIGS. 9A-9F). The crown 133 is fixed to the carriage 139 149 159, which houses inside the transmission mechanism 114 112 113 (in this embodiment, double gearwheel mechanism 130 131). In its movement (rotation), the crown 133 drags the carriage 139 149 159. Next we refer to the particular case of the structure for rehabilitating an index finger. However, the following explanation refers similarly to the structures for rehabilitating the three fingers (see for example FIGS. 4A to 4H) and to the structure for rehabilitating a thumb. The support for the intermediate phalanx of the fingers (intermediate support or proximal support) is fixed to the carriage 139 such that the movement of the motor 111 produces an angular displacement of the carriage 139 (by means of the rotation of the crown 133) and a corresponding angular displacement of the support 121 123 for the intermediate phalanx. The transmission mechanism 130 131 (double gearwheel) comprises an input wheel 135A 136A and an output wheel 135B 136B. Input wheel 135A 136A and output wheel 135B 136B are connected to each other such that the input wheel 135A 136A does not move when the carriage 139 moves (angular displacement) but produces a rotation of the output wheel 135B 136B. Additional features applicable to the particular embodiment in which each finger (index on the one hand and middle, ring and little fingers on the other hand) is rehabilitated in two sections (FIGS. 1-3C), are explained next. The following explanation fully applies to the thumb because the distal phalanx support is the same in all three modules (index, fingers, thumb). The support 120 122 for the distal phalanx of the finger (distal support) is fixed to the output wheel 125B 136B such that the movement of the motor 110 111 109 produces an angular displacement of the carriage 139 and a corresponding angular displacement of the support 120 122 for the distal phalanx. In addition, the movement of the carriage 139 produces a rotation of the output wheel 135B 136B and that rotation produces and angular displacement of the support 120 122 for the distal phalanx with respect to the position of the carriage 139. As explained, the angular displacement of the distal phalanx support 121 123 is greater than the angular displacement of the intermediate phalanx support 120 122.

The motor 110 111 109 can be selectively activated by the user (or by a therapist) for operation of the device. In a preferred embodiment, the motor is battery powered a. Alternatively, it could be powered by conventional available electricity or pressurized fluid such as compressed air in the case of a device fitted with pneumatic motors. For simplicity reasons, in FIGS. 6 and 7 the pinion 132 and the crown 133 are not shown because they are housed in a casing, housing or base 134. FIG. 3B clearly shows motor 109 and its pinion 162, motor 110 and its pinion 172 and motor 111 and its pinion 132.

In FIG. 6, the transmission mechanism (double gearwheel mechanism) 130 is formed by two toothed gearwheels: an input toothed gearwheel 135A and an output toothed gearwheel 135B (also referred to as gear train) engaged by respective teeth. The input toothed gearwheel 135A is mounted in the rotational axis 160 of the carriage 139 such that when the carriage rotates by the rotation of the crown 133, the input gearwheel 135A does not move. The output gearwheel 135B is mounted in the carriage 139 through its axis 180 so the output gearwheel 135B moves when the carriage 139 moves but can rotate freely in the carriage 139. As the input gearwheel 135A is engaged to the output gearwheel 135B (through a toothed edge) when the movement of the carriage 139 drags the output gearwheel 135A, the output wheel 135B is forced to rotate over the input gearwheel 135A. The intermediate phalanx support 121 123 is fixed to the carriage 139 whilst the distal phalanx support 120 122 is fixed to the output gearwheel 135B. That way, the angular displacement of the intermediate phalanx support 121 123 is the displacement of the carriage 139 whilst the angular displacement of the distal phalanx support 120 122 is the displacement of the carriage plus the rotation of the output gearwheel 135B. The angular displacement of the distal phalanx support 121 123 and intermediate phalanx support 120 122 produce the flexion/extension of the fingers (either index finger, thumb or remaining fingers).

In FIG. 7, the transmission mechanism (double gearwheel mechanism) 131 is formed by two discs or wheels, an input wheel 136A and an output wheel 136B which do not touch directly each other and a coupling means or mechanical coupling (such as a coupling rod) 137 connecting the two discs or wheels together. The coupling means 137 is fixed to the input and output wheels 136A 136B such that the distance between the connecting points of the input and output wheels 136A 136B is fixed.

The input wheel 136A is mounted in the rotational axis 160 of the carriage 139, such that when the carriage rotates by the rotation of the crown 133, the input wheel 136A does not move. The output wheel 136B is mounted in the carriage through its axis 180. So the output wheel 136B moves when the carriage 139 moves, but can rotate freely in the carriage 139. As the input wheel 136A is engaged to the output wheel 136B (through a coupling rod 137), when the movement of the carriage 139 drags the output wheel 136B, the output wheel 136B is forced to rotate by the connecting rod 137 to maintain the distance between the connecting points of the input and output wheels 136A 136B. The proximal phalanx support 121 123 is fixed to the carriage 139 whilst the distal phalanx support 120 122 is fixed to the output wheel 136B. That way the angular displacement of the proximal phalanx support 121 123 is the displacement of the carriage 139, whilst the angular displacement of the distal phalanx support 120 122 is the displacement of the carriage plus the rotation of the output wheel 136B. The angular displacement of the distal phalanx support 120 122 and proximal phalanx support 121 123 can produce the flexion/extension of the fingers (either index finger, thumb or remaining fingers).

Figure 8:
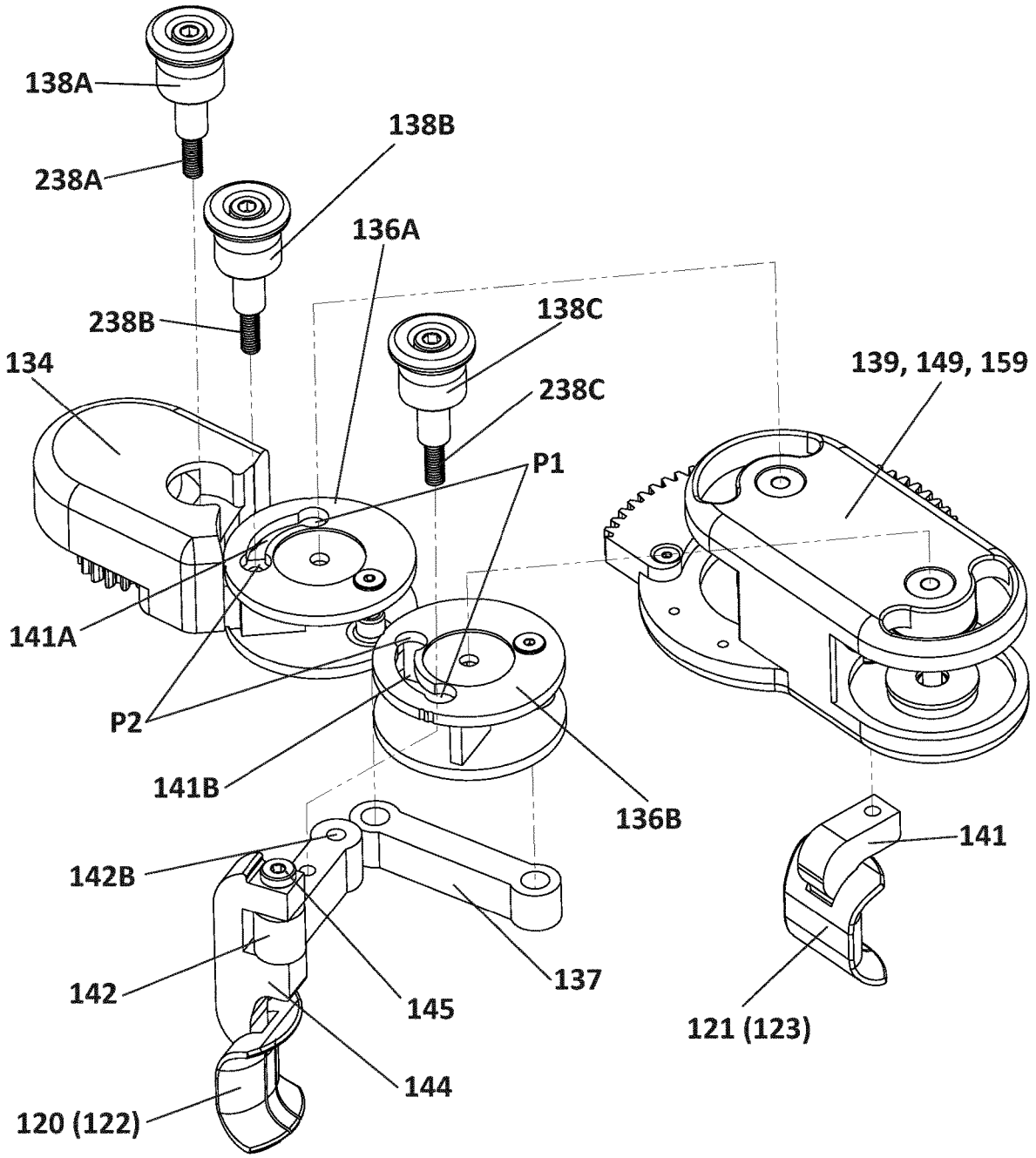
FIG. 8 shows a break-up of the transmission mechanism in FIG. 7.

FIG. 8 shows a break-up of the transmission mechanism (double gearwheel mechanism) 131 in FIG. 7. A first casing, housing or base 134 houses the pinion 132 and partially the crown 133. Note that we refer generally to pinion 132 but we could refer correspondingly to pinion 162 172 (see for example FIG. 3B). This is the same as in the transmission mechanism 130 shown in FIG. 6. A second casing or carriage 139 houses the fixed wheel 136B, the moving wheel 136A and the mechanical coupling 137 (in the transmission mechanism 130 in FIG. 6, the carriage 139 houses the double toothed gearwheel). Like in the transmission mechanism (double gearwheel mechanism) 130 in FIG. 6, the crown 133 is fixed to the lower part of the carriage 139. In the shown embodiment, the input wheel 136A and the output wheel 136B are identical, and are formed by two flat discs disposed parallel to each other and fixed one another by any kind of mechanical attachment 137 (connecting rod) which establishes a fixed distance between the connecting points of the input and output wheels 136A 136B. The input wheel 136A and the carriage 139 comprise an elongated canal 141A, which defines two end positions P1 P2 for the angular displacement of the carriage 139, to control the maximum extension movement possible for the fingers. Pin 138B is used to constrain the proximal pivot point for link (mechanical attachment) 137. For a right hand configuration, the pivot point is on the left (FIG. 8 top). For a left hand configuration, the pivot point is on the right. Pin 138B has the exact function as pin 138A, that is to say, to define the position of the distal pivot point for link (mechanical attachment) 137. For a right hand configuration, the distal pivot point is on the right. For a left hand configuration, the point is on the left. Pin 138C is mounted on the carriage 139. The shaft 238C of pin 138C is housed in the elongated canal 141B so that during the angular displacement of the carriage 139, the canal 141B moves around pin 138C, but collides with the shaft 238C of the pin at the end of the stroke imposed for the carriage 139 (depending on the maximum extension movement established for the fingers). These two positions P1 P2 defined in the input wheel 136A also permit the implementation of the reversibility feature of the device. They also contribute to security, since for example they prevent damage on the user in the event a motor fails. When the device is configured to rehabilitate a left hand, pin 138C is in position P1. On the contrary, when the device needs to be reconfigured in order to rehabilitate a right hand, pin 138C is placed in position P2. The support or rest for the intermediate phalanx (121 in the case of index finger, 123 in the case of middle, ring or little fingers) is coupled to carriage 139 by means of attaching means 141.

FIG. 8 shows the particular embodiment in which rehabilitation of the fingers is done in two sections. In order to achieve this two-section rehabilitation, the support or rest for the distal phalanx (120 in the case of index finger, 122 in the case of middle, ring or little fingers) is coupled to the output wheel 136B by means of a part 144 on which the support (120, 122) is fixed. This part 144 is connected to the output wheel 136B by means of pivoting means 142 connected in one end to part 144 (for example by means of a screw 145) and in the other end 142B to the output wheel 136B and second housing 139 (for example by means of a screw 146 as shown in FIG. 6). This connection permits additional travel of the distal support 120 (or 122) with respect to the maximum rotation achieved by the carriage 139. The angle travelled by the distal phalanx is therefore larger than the angle travelled by the proximal phalanx. In a particular embodiment, the device is designed for the distal phalanx to travel an angle which is around twice the travel of the angle travelled by the proximal phalanx. FIG. 8 also shows the support for the proximal phalanx (121 in the case of index finger, 123 in the case of middle, ring or little fingers) and the part 141 on which the support is fixed. This part 141 is connected to the support. These parts 141 144 and their corresponding supports are also shown in FIG. 3C.

Figure 9A:
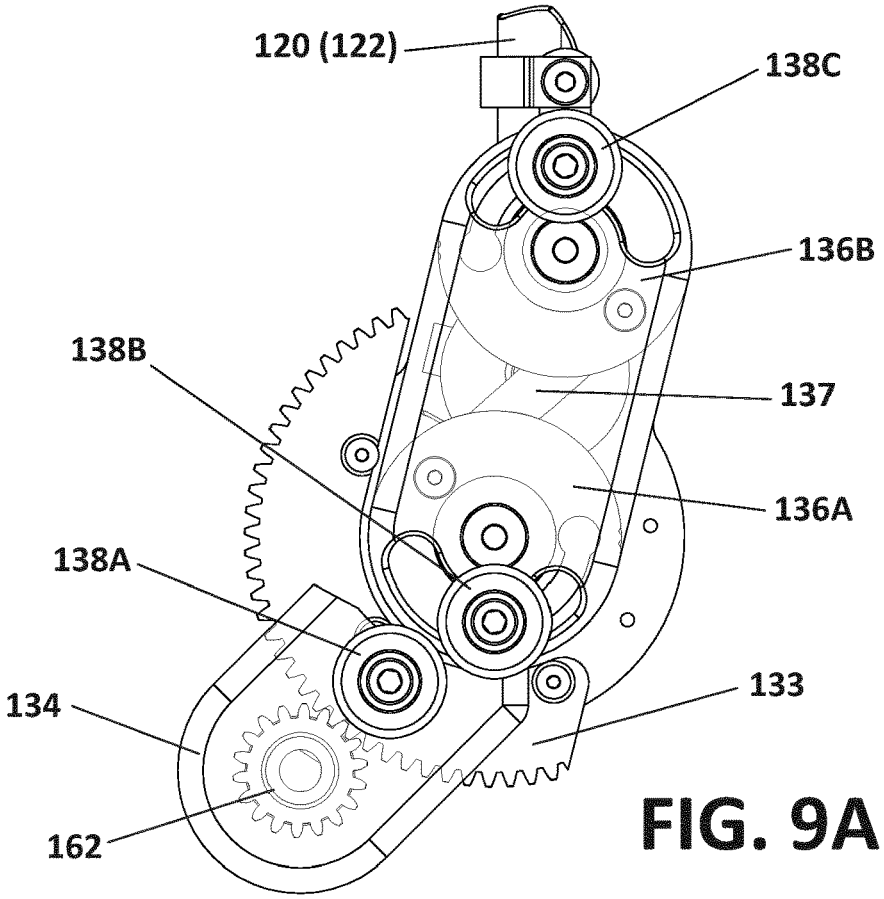
FIGS. 9A-9F show several positions of the flexion/extension mechanism for the finger support shown in FIG. 7.
Figure 9B:
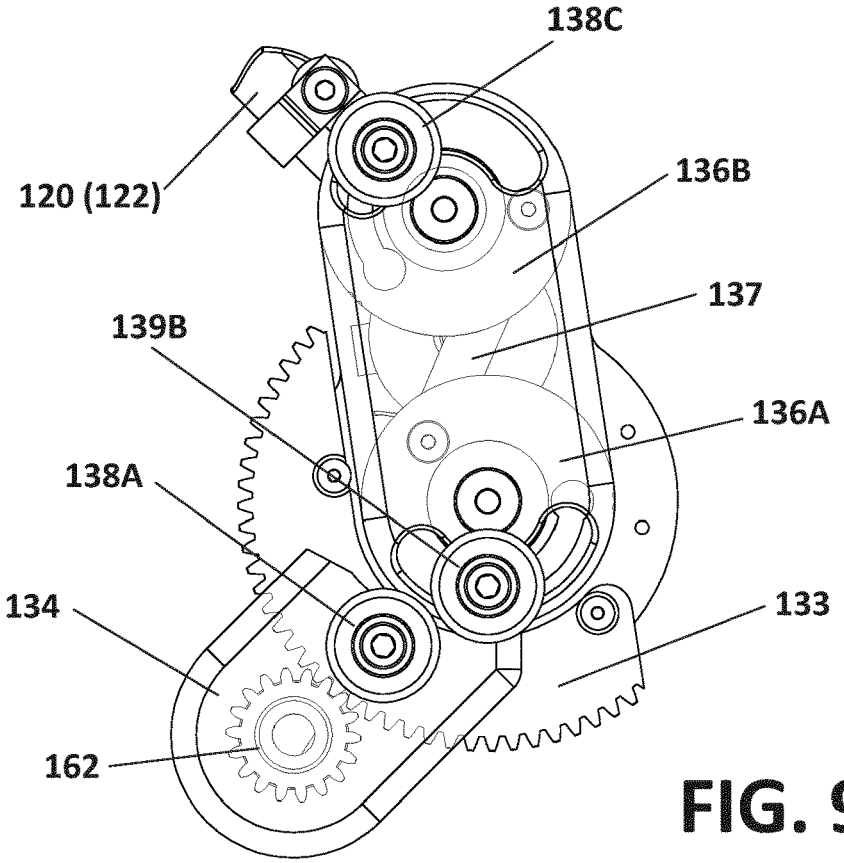
Figure 9C:
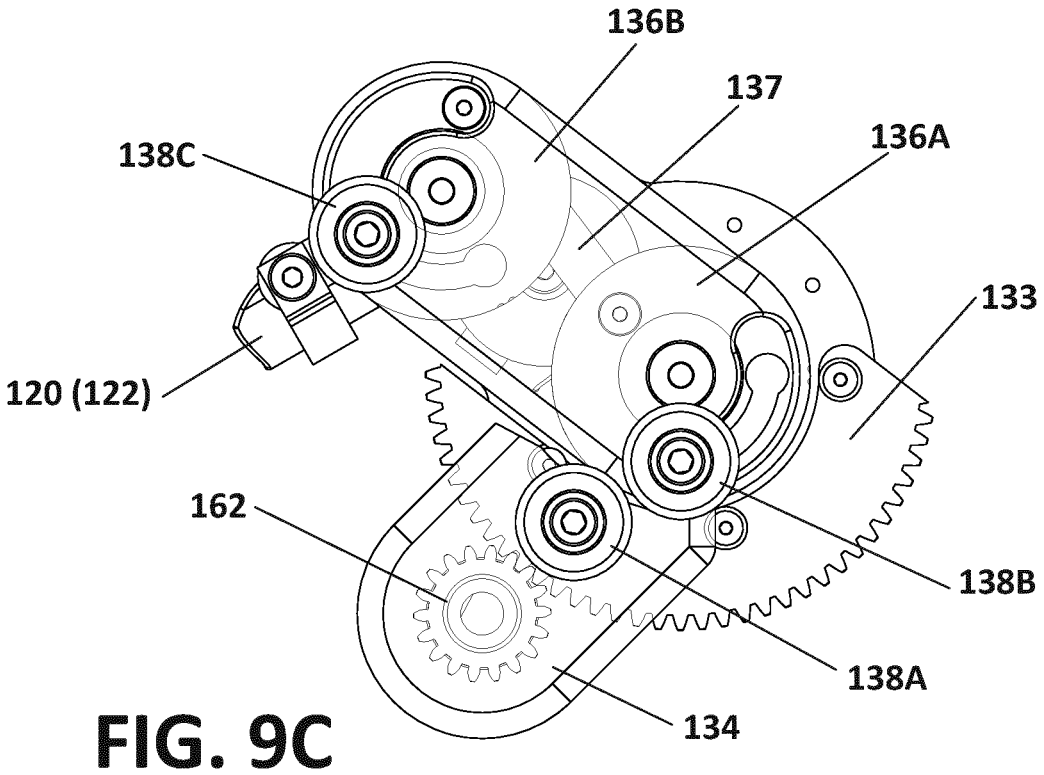
Figure 9D:
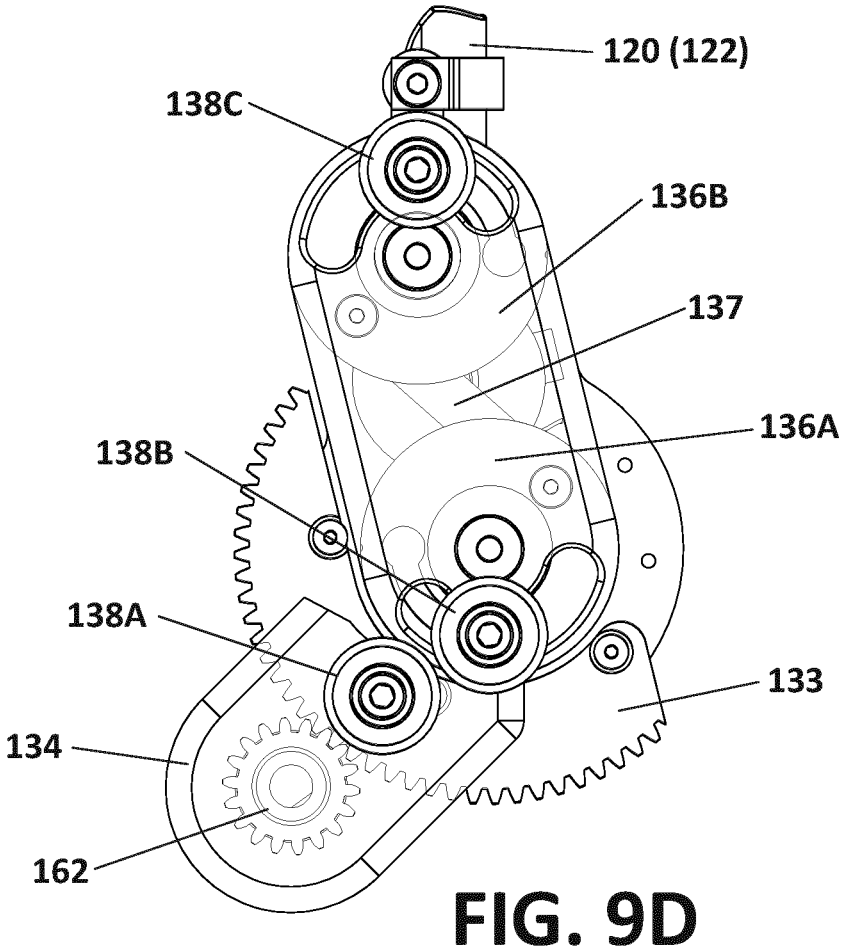
Figure 9E:
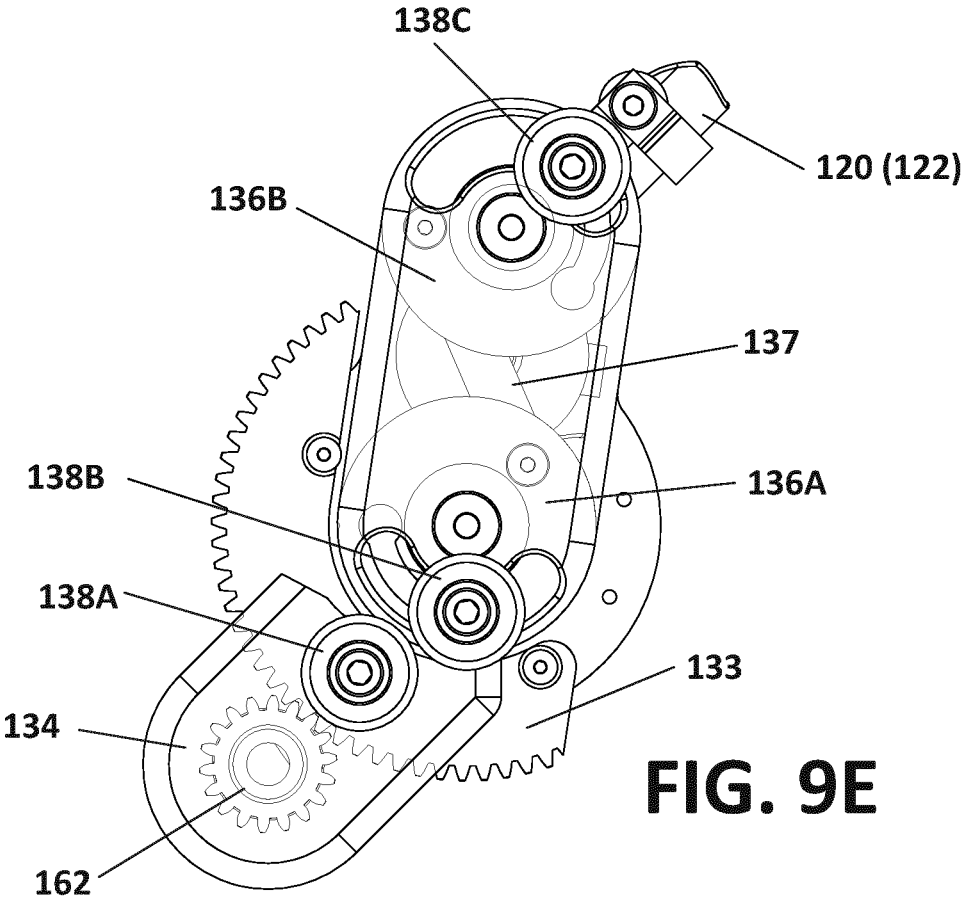
Figure 9F:
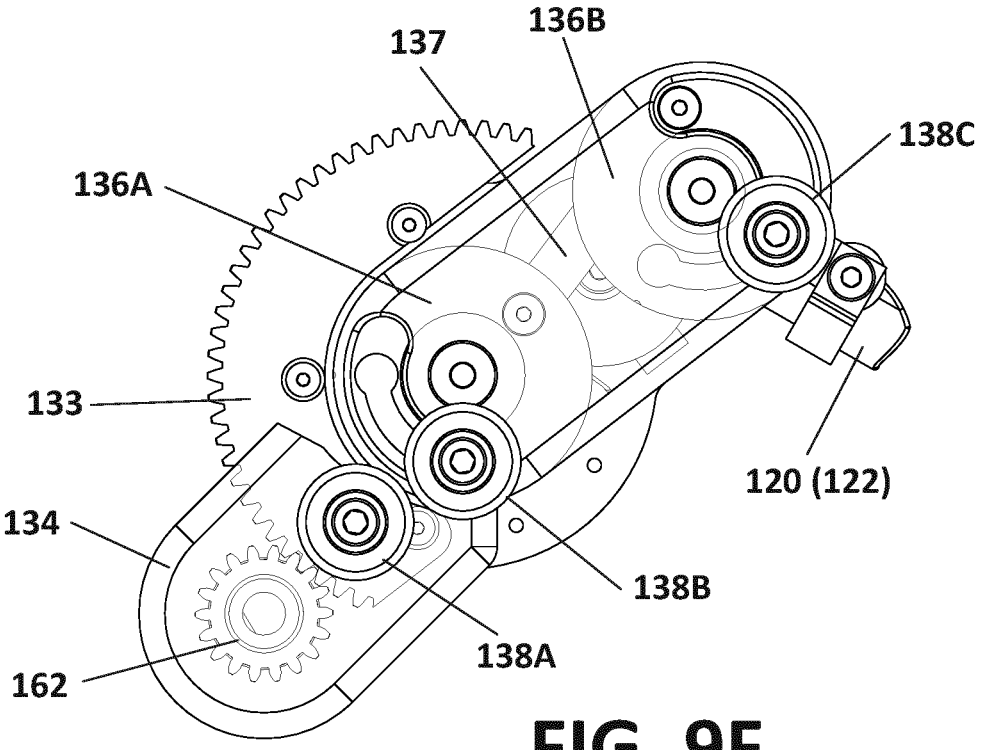

FIGS. 9A-9F show several positions of the mechanism of the flexion/extension of the fingers (in this case the mechanism 131 is implemented as shown in FIG. 7). These positions can refer to the index finger, or to the three other fingers and even to the thumb, if two-sections for the two phalanxes were implemented. FIGS. 9A-9C refer to a sequence for a right hand. FIG. 9A refers to a position with substantially maximum extension while FIG. 9C refers to a position with substantially maximum flexion. FIGS. 9D-9F refer to sequence for a left hand. FIG. 9D refers to a position with substantially maximum extension while FIG. 9F refers to a position with substantially maximum flexion. As can be observed, wheel 136A and pin 138B remain fixed with respect to the housing, casing or base 134. The carriage 139 rotates actioned by crown 133 in turn actioned by the pinion 162 (or 132 172) moved by a motor (not shown). The crown 133 drags carriage 139 and in turn the mechanical coupling 137 moves the output wheel 136B.

Figure 10A:
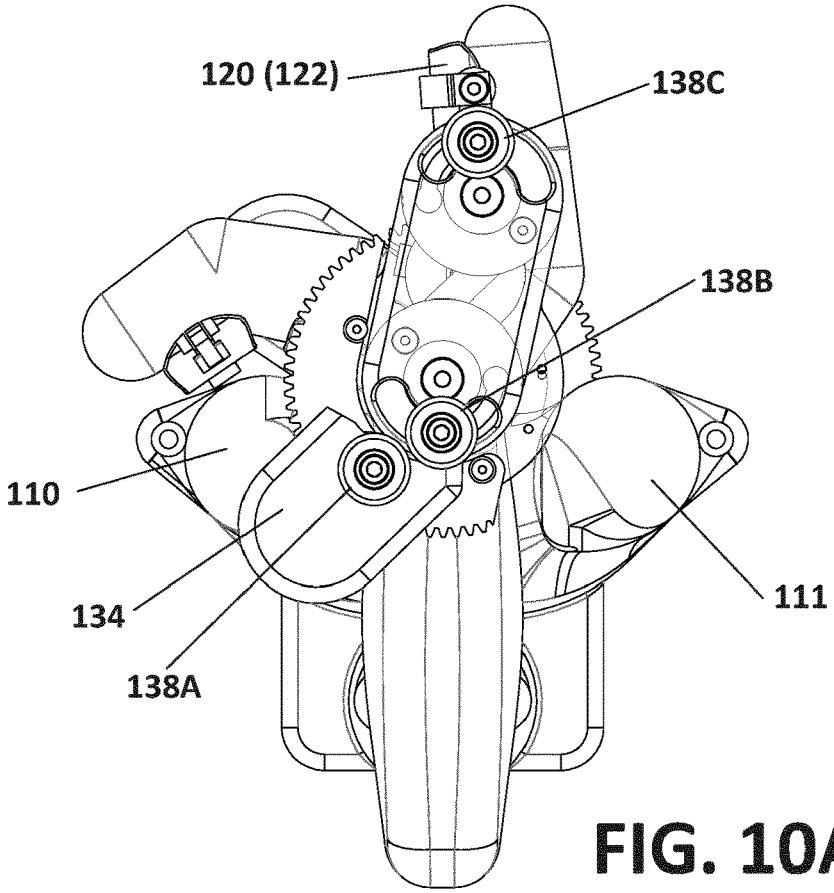
FIGS. 10A-10F show several positions of the mechanism for the flexion/extension of the finger shown in FIGS. 7, 8 and 9A-9F (FIGS. 10A-10C right hand.
Figure 10B:
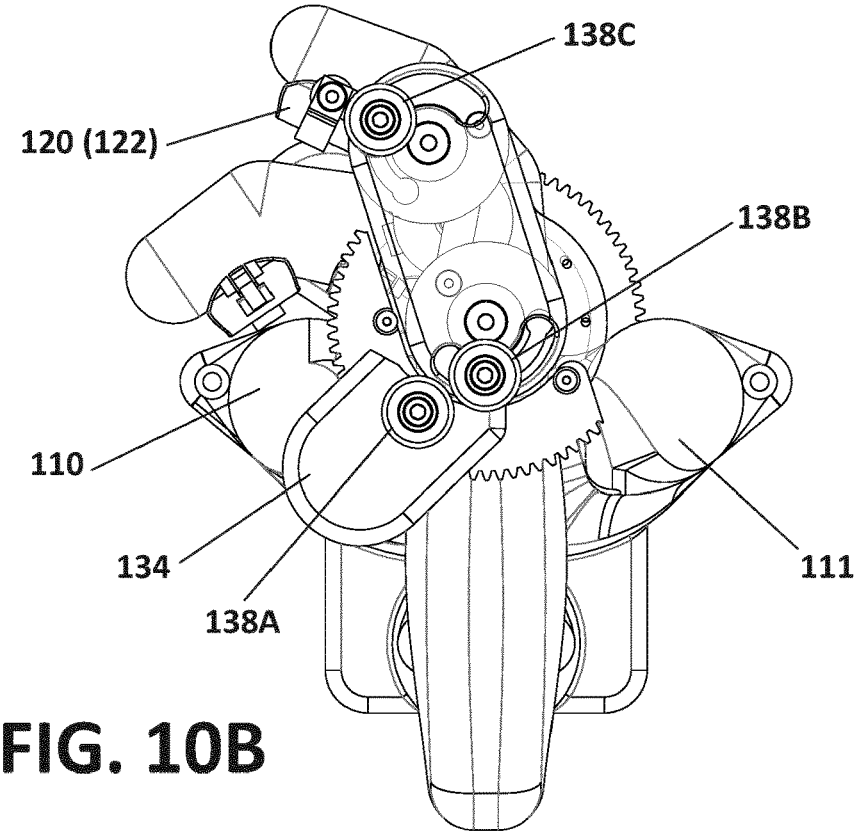
Figure 10C:
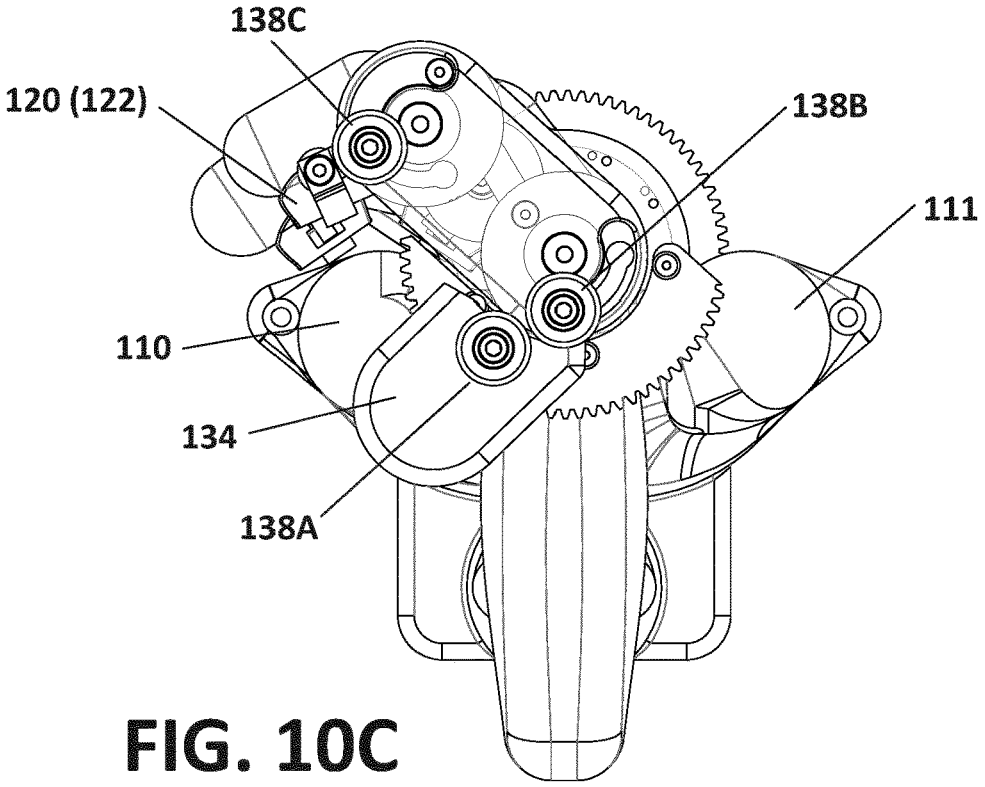
Figure 10D:
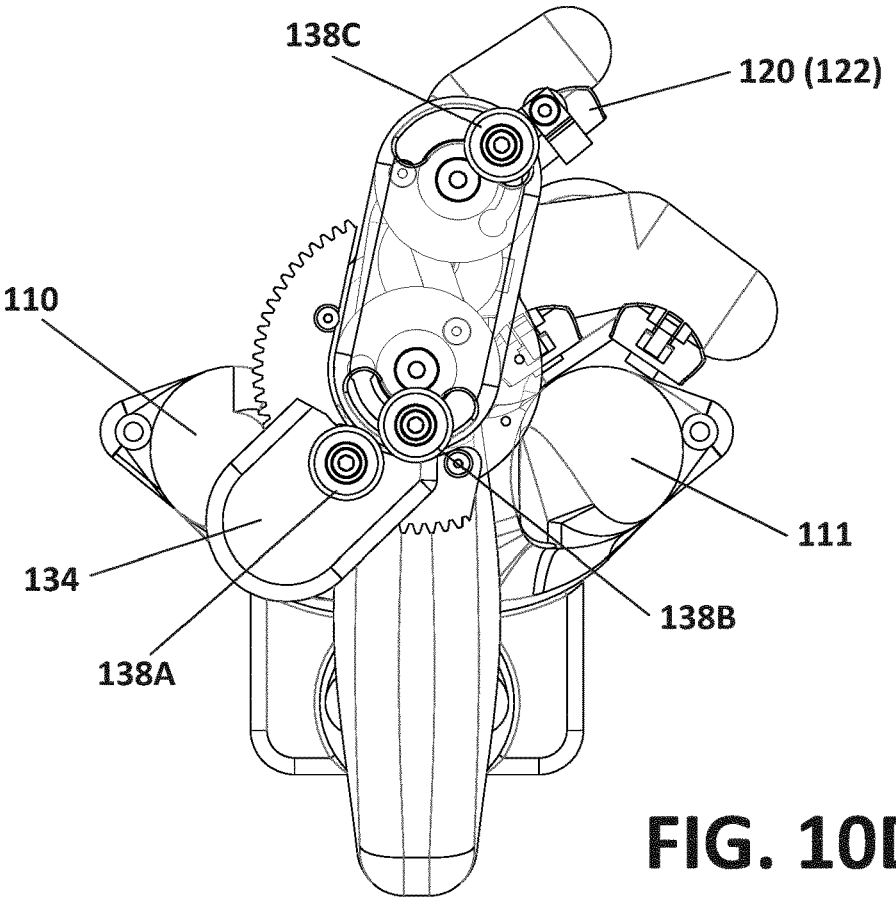
Figure 10E:
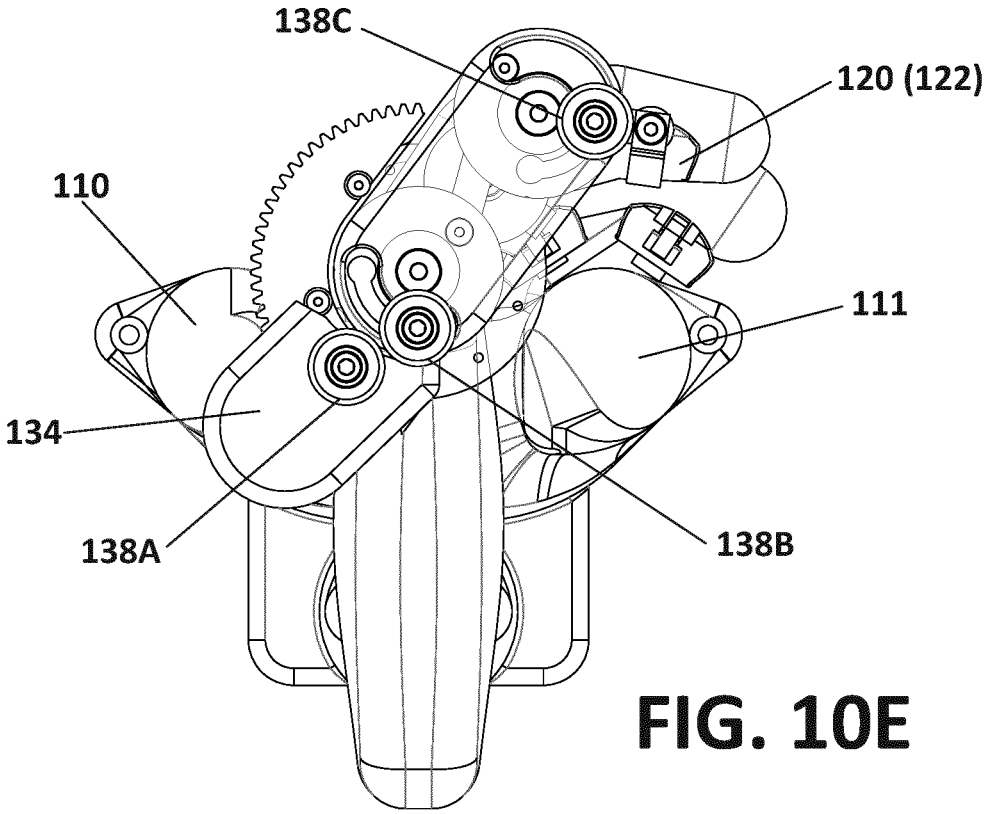
Figure 10F:
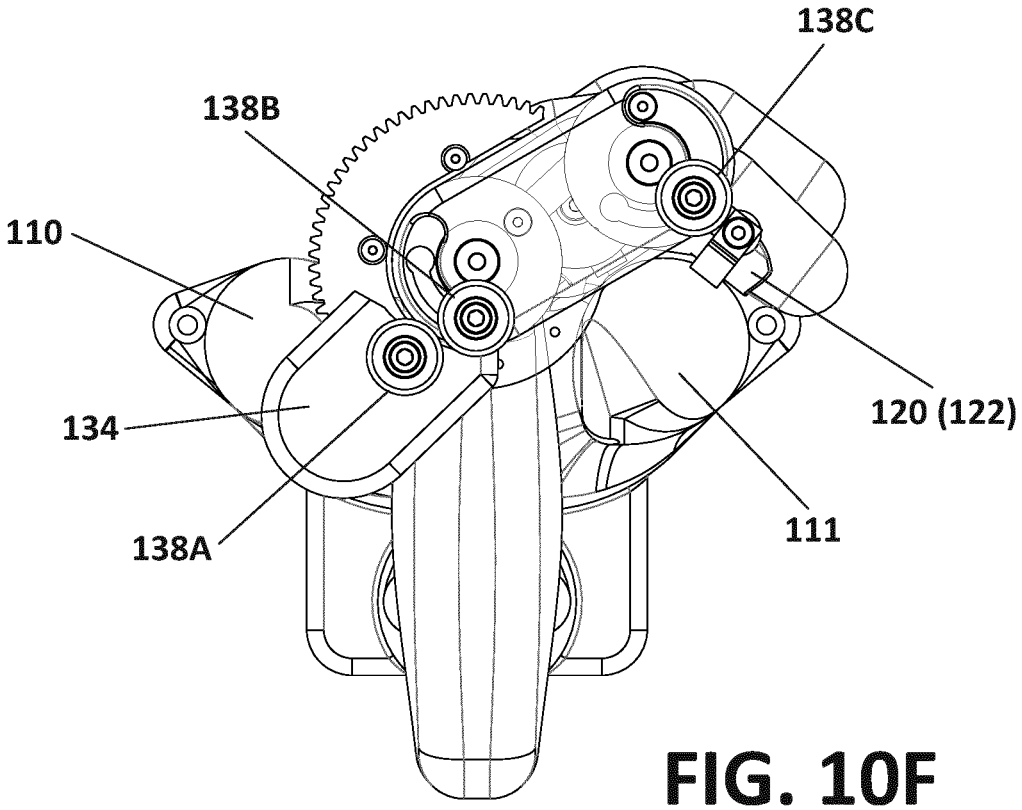

FIGS. 10A-10F show several positions of the mechanism of the flexion/extension of the index finger (right hand in FIGS. 10A-10C and left hand in FIGS. 10D-10F).

Figure 1:
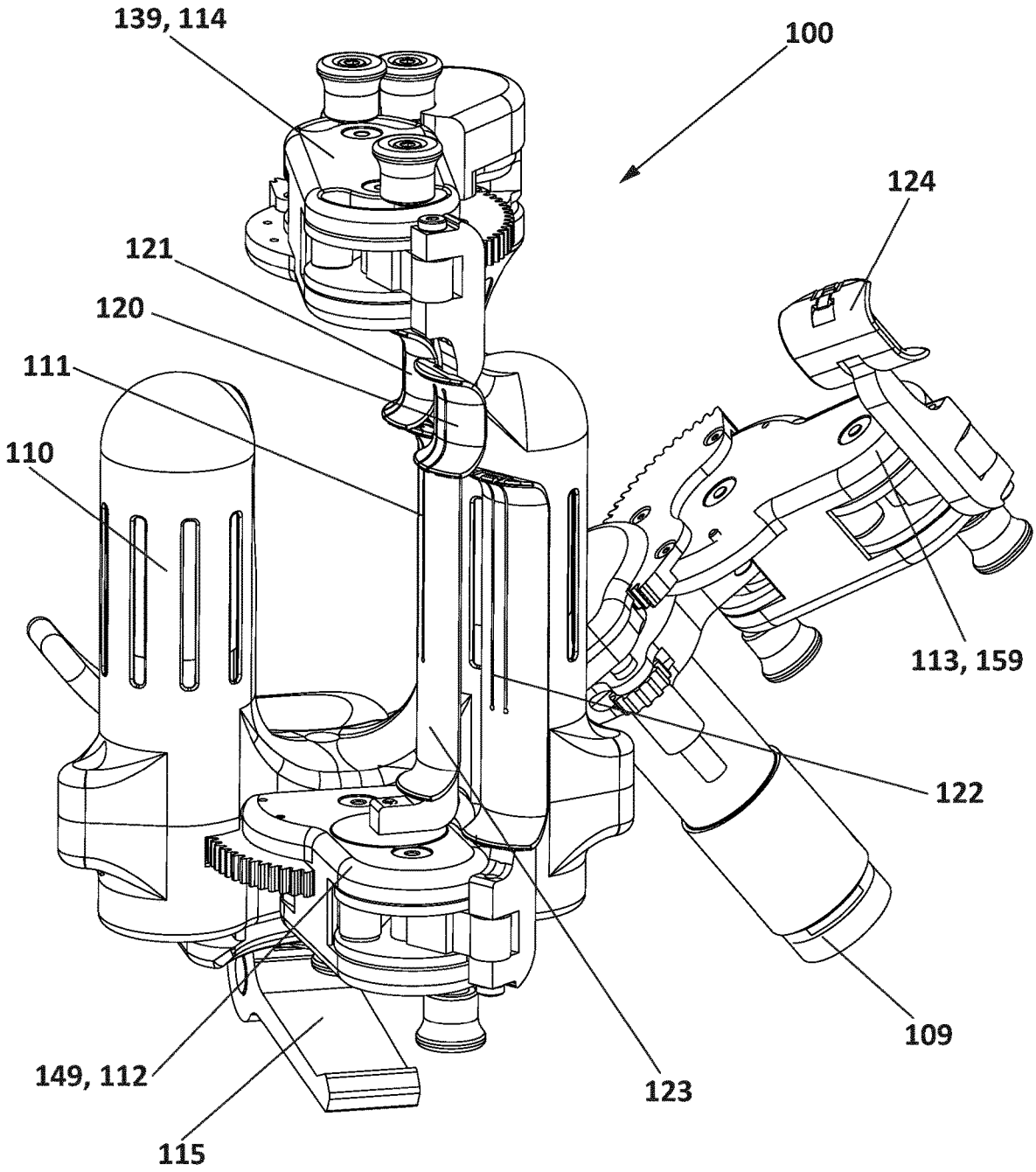
FIG. 1 shows a view of a hand rehabilitation device configured for rehabilitating a right hand, according to a possible embodiment of the disclosure.
Figure 11A:
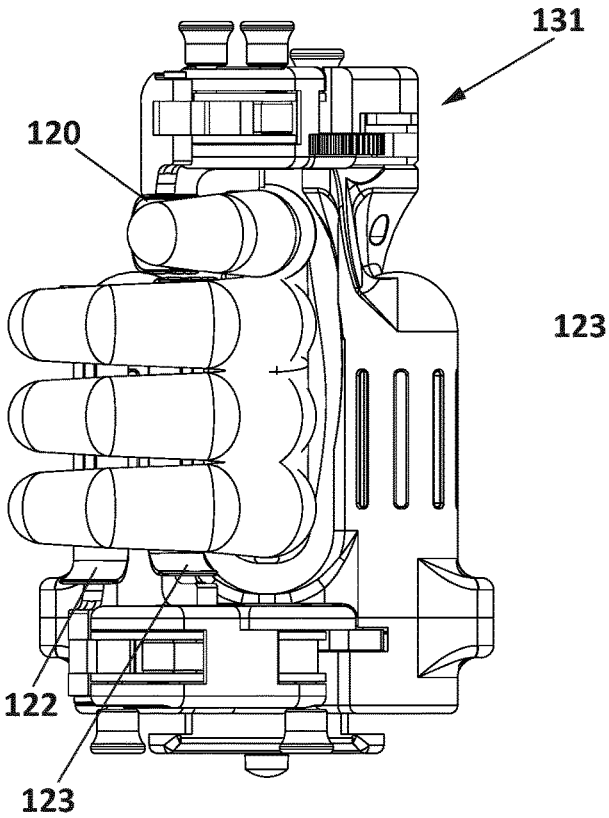
FIGS. 11A-11D show the rehabilitation device in FIGS. 1-3, configured for rehabilitating a left hand, which is included. For clarity reasons the thumb has been erased from the view.
Figure 11B:
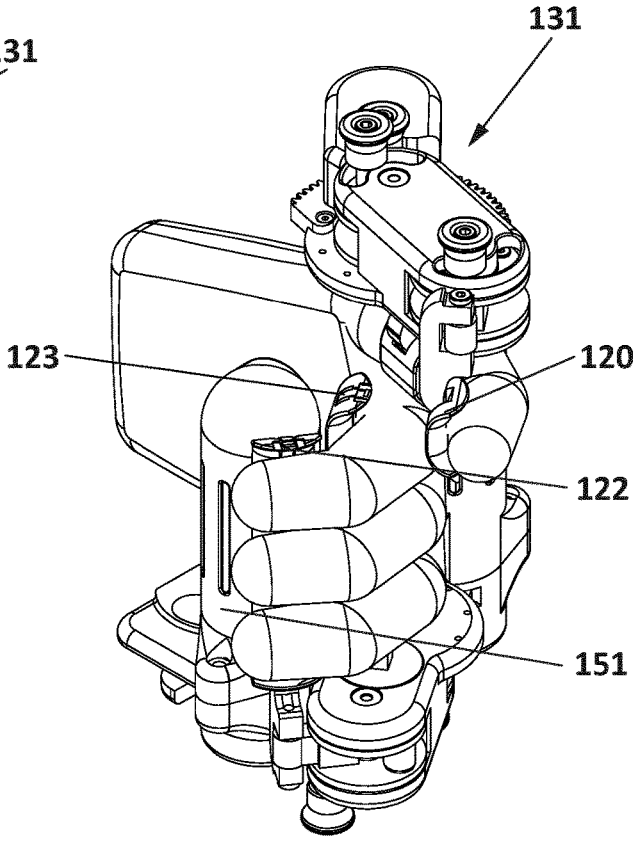
Figure 11C:
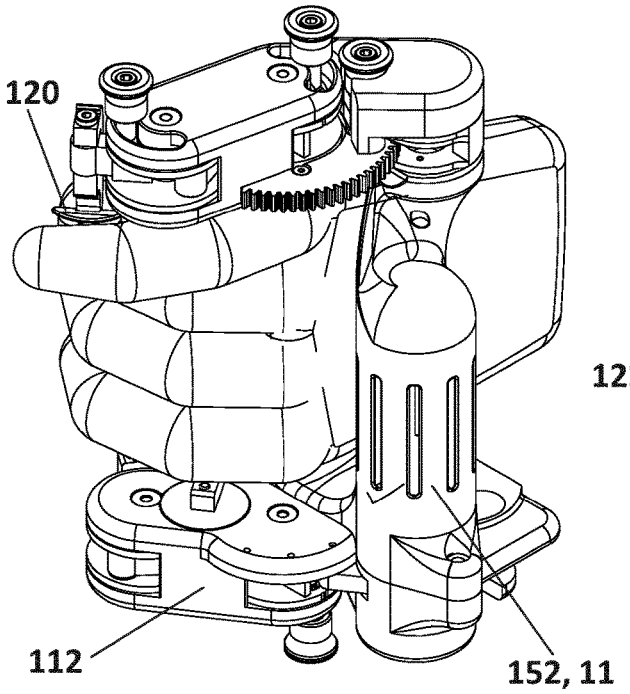
Figure 11D:
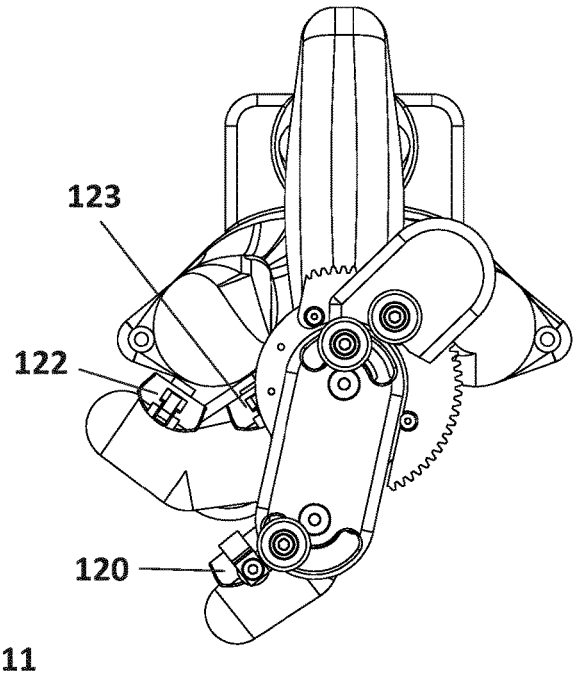
Figure 12A:
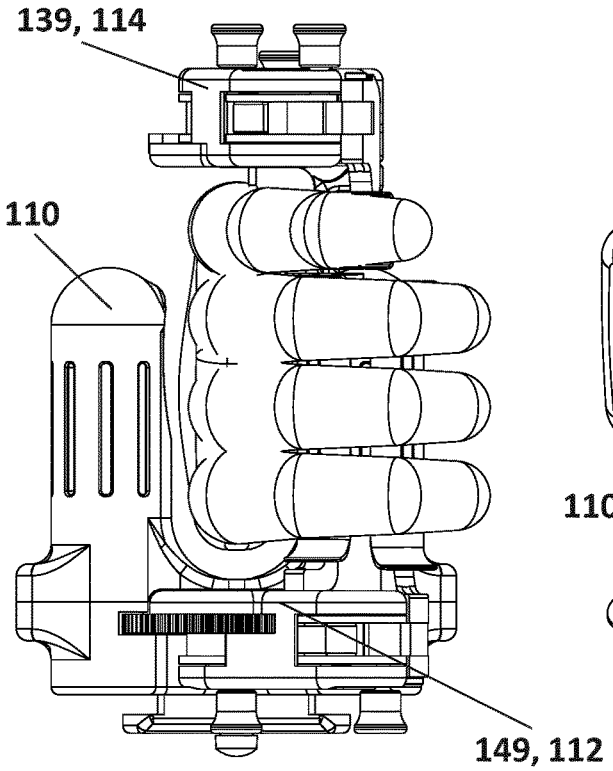
FIGS. 12A-12D show the rehabilitation device in FIGS. 1-3, configured for rehabilitating a right hand, which is included. For clarity reasons the thumb has been erased from the view.
Figure 12B:
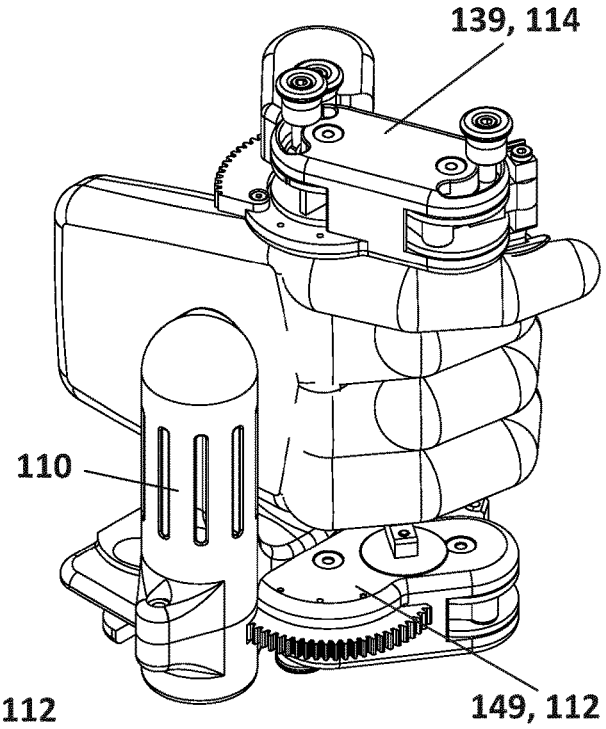
Figure 12C:
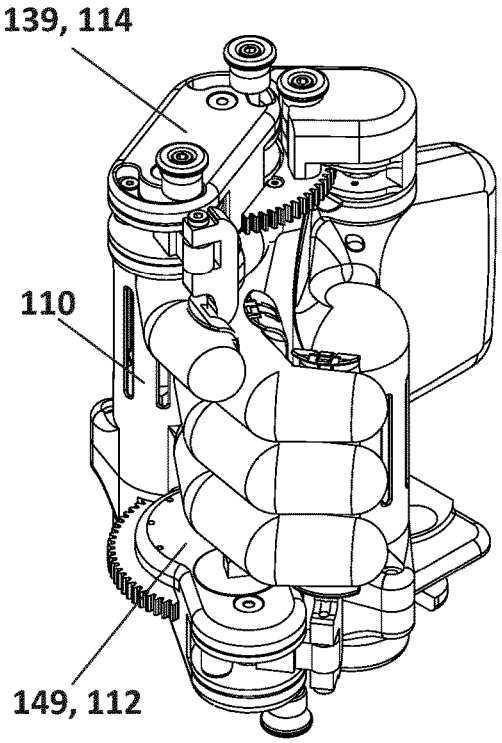
Figure 12D:
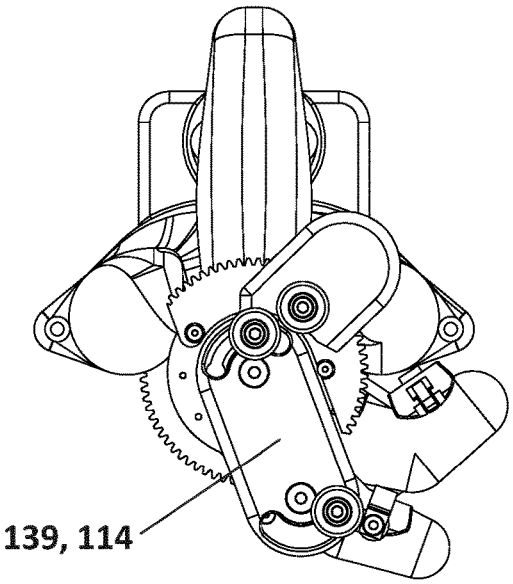

FIGS. 11A-11D show different views of the hand rehabilitation device shown for example in FIG. 1, but in this case configured to rehabilitate a left hand, which is illustrated in its functional position for rehabilitation. In this figures, the casings of the transmission mechanism 114 for the index finger has been erased, in order to show the functioning of the double gearwheel mechanism 131. The transmission mechanism 112 for the group of middle, ring and little fingers works in a similar way. In FIG. 11B the casing 151 in which the motor 110 which actuates the transmission mechanism 112 for the group of middle, ring and little fingers is shown. It is remarked that the location of the motors may vary in different designs of the device. Reference 152 is the casing in which motor 111 is housed. The casing that houses the transmission mechanism 114 for the index has been erased, in order to show the transmission mechanism 114. The transmission mechanism 112 for the three fingers is also shown (in this case hidden by its casing). The thumb has been erased from these views for clarity purposes. FIGS. 12A-12D show different views of the same hand rehabilitation device, in this case configured to rehabilitate a right hand. Again, the thumb has been erased from these views for clarity purposes.

As already mentioned, the device is reversible. This means that the same device can be used to rehabilitate both a right hand and a left hand. The transmission mechanism illustrated in FIG. 6 does not require any reconfiguration in order to switch from a "right hand configuration" to a "left hand configuration" or vice versa. That is to say, reversibility is automatic. FIGS. 13A-13D illustrate the reversibility capability of the transmission mechanism of FIG. 7. Since there are 3 transmission mechanisms in one device (index finger, 3 fingers and thumb), the reconfiguration must be done three times, because each finger requires reorienting wheels 136A and 136B and lock with pins 138B and 138C. That is to say, in order to perform reconfiguration, the pins 138B 138C must be lifted, then wheels must be turned, so that the pin naturally locks into position in the opposite end of the circular groove (canal) with the round holes in the ends. Alternatively, pins 138B 138C could be one single mechanism in order to simplify the process. Additionally, the thumb lock mechanism also needs to be reconfigured. Turning back to FIG. 8, during reconfiguration, the set formed by support 120 (or 122) and part 144 moves freely with respect to screw 145. Similarly, the set formed by support 121 (or 123) and part 141 moves freely with respect to corresponding screw (both if the transmission mechanism in FIG. 6 and in that in FIG. 7).

Figure 13A:
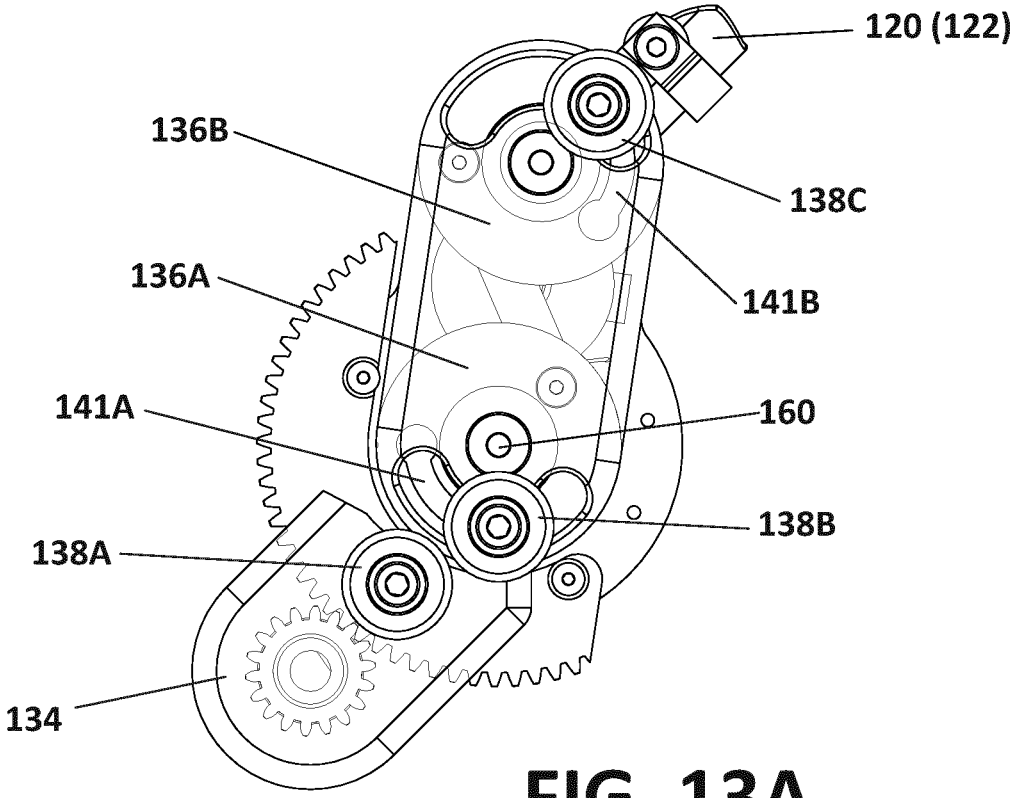
FIGS. 13A-13D show the reversibility capability of the transmission mechanism of the device.
Figure 13B:
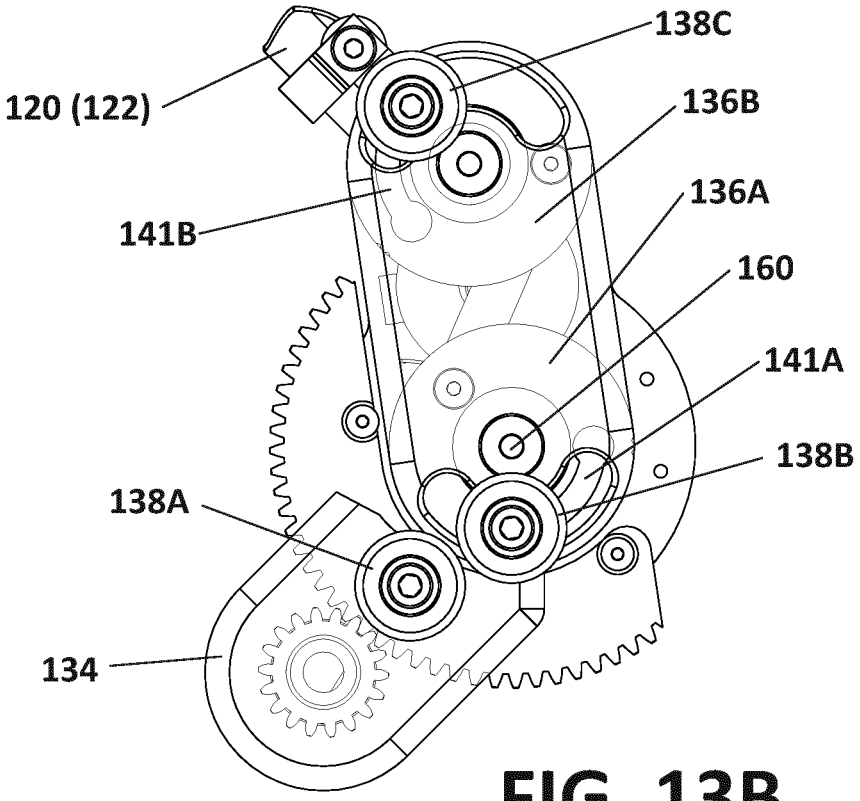
Figure 13C:
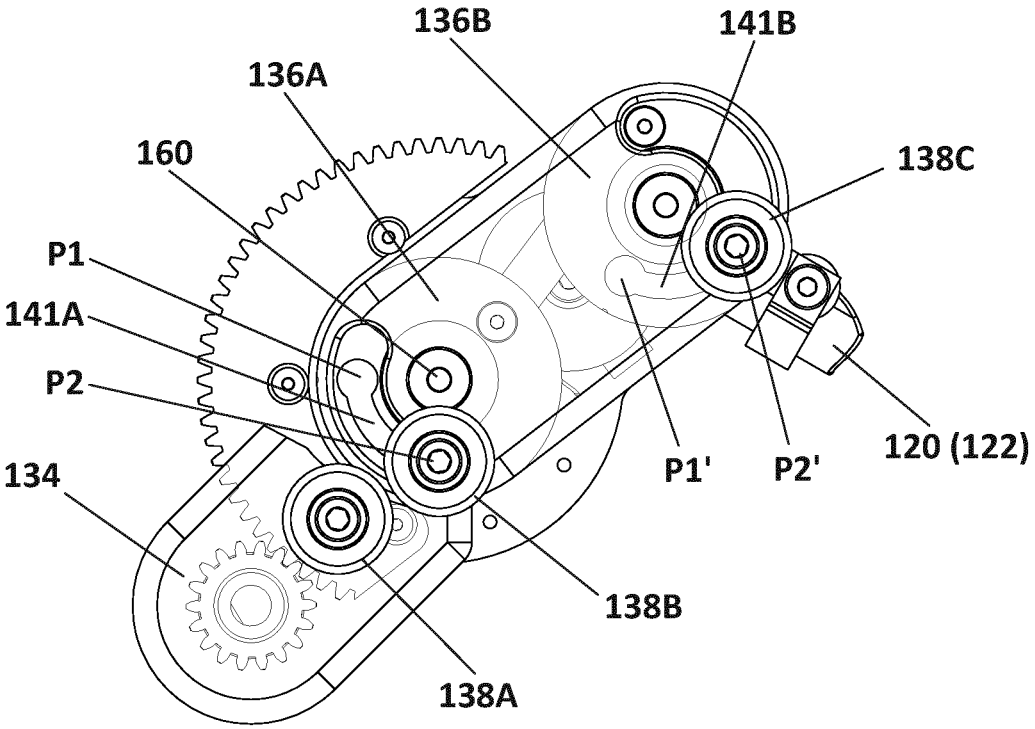
Figure 13D:
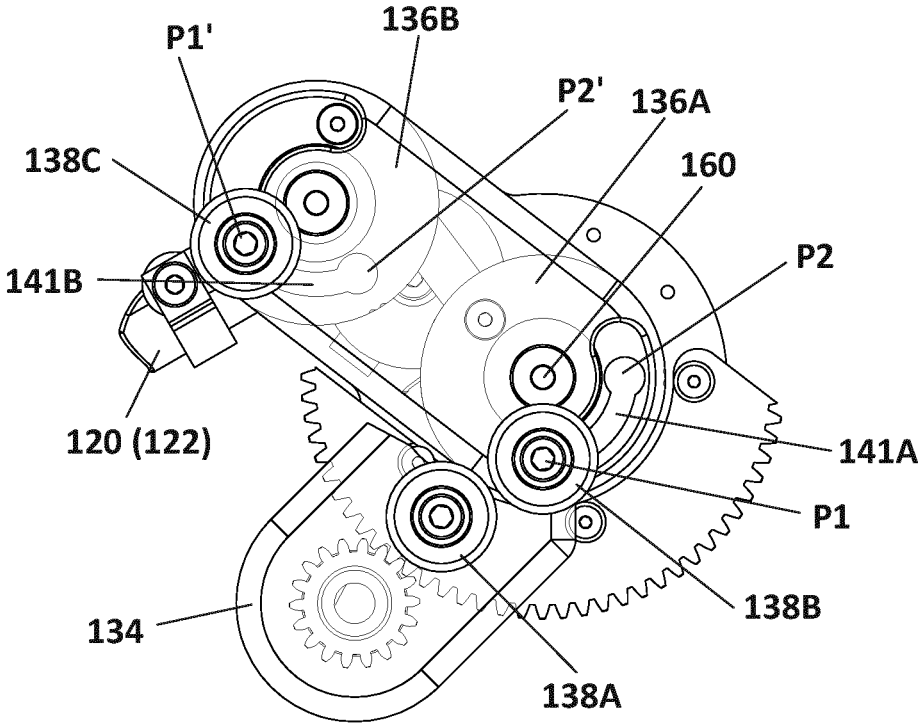

FIGS. 13A and 13C show the left hand configuration, while FIGS. 13B and 13D show the corresponding right hand reconfiguration. In the reconfiguration process from left to right hand (it would be similar from right to left hand), the housing or base does not change position. Pin 138B, which in left-hand configuration is positioned in position P2 (see FIG. 8) in output wheel 136B is moved to position P1 (see FIG. 8). The mechanical coupling (transmission bar) 137 becomes naturally re-oriented when the wheels 136A 136B change position. Pin 138B also changes position from position P2' (left hand configuration) to position P1' (right hand configuration). Pivoting axis 160 is maintained in both left-hand and right-hand configurations, independently from the positions of motors. The casing, housing or carriage 139 pivots or rotates around this pivoting axis 160. Pin 138A does not have any influence in reconfiguration. As already mentioned, the transmission mechanism shown in FIG. 6 does not need any change in order to be reconfigured, except for the free movement of the set formed by support 120 (or 122) and part 144 and the free movement of the set formed by support 121 (or 123) and part 141. In both mechanisms, it is possible to add safety pins in order to prevent over-travel of the hand in the event of failure of a motor.

The device 100 permits two symmetrical grasp modes supported for each of left-hand and right-hand operation: cylindrical mode (for grasping for example a glass) and "open pinch/clamp" for 3-fingered grasp (predominantly MCP action).

FIGS. 1, 2A, 2B, 3A, 3B and 3C show different views of a hand rehabilitation device 100 according to a possible embodiment of the disclosure. The device 100 is versatile, meaning that it can be configured for rehabilitating either a right hand or a left hand. The configuration shown in these figures is a right-hand configuration, but it can simply be switched to a left-hand configuration, as will be explained later in this text. The device 100 can be attached to another device or apparatus, such as to a tool robot, a manipulator or an arm support (for example a support fixed on a table), or directly to the arm of the user. It can also act as a hand-held device.

The portable device 100 is configured to be grasped by the hand to be trained, in such a way that the palm, fingers and thumb (inner part of the hand) surround the grasped device 100. In this particular implementation, the structure 110 is to be grasped by a right-hand, as shown in FIG. 2B. When grasping the hand-held device 100 by an impaired hand, the inner part of the fingers and thumb are disposed on several supports or "finger rests" 120 121 122 123 124 disposed to receive the fingers and thumb, which rest or are supported on the supports. Optionally, a strap can be included, in order to ensure that the fingers are attached to the device. The strap can be especially useful for finger flexion (hand closing movement). In the shown embodiment, two finger rests 120 121 are disposed for receiving the respective distal phalanx and at least a portion of the intermediate phalanx (or the whole intermediate phalanx) of the index finger (inner part thereof) and two finger rests 122 123 are disposed for receiving the respective distal phalanx and at least a portion of the intermediate phalanx (or the whole intermediate phalanx) of another group of fingers, formed by middle, ring and little fingers (inner part thereof). In other words, the two upper finger rests 120 122 end up between the distal and the intermediate phalanx of the index finger and middle, ring and little fingers, respectively, while the two lower finger rests 121 123 end up between the proximal and the intermediate phalanx of the index finger and middle, ring and little fingers, respectively. As shown for example in FIG. 3A, the supports or rests 120 121 for the index finger are attached to a structure (carriage) 139, which holds the transmission mechanism 114 for those rests 120 121. FIG. 3C shows the attaching means 144 141 for supports 120 121, respectively. Similarly, the supports or rests 122 123 for the middle, ring and little fingers are attached to a structure (carriage) 149 which holds the transmission mechanism 112 for those rests 122 123. The view of FIG. 1 and the rotated view of FIG. 3A show an additional support or rest 124 for the thumb. The disposition of this thumb rest 124 with respect to the other finger rests has been selected to be adapted to the natural shape of the hand. The support or rest 124 for the thumb is attached to a structure (carriage) 159 which holds the transmission mechanism 113 for that rest 124. In the figures, other elements can be observed, such as: a motor 110 for actuating the supports or rests 122 123 for the middle, ring and little fingers (the casing of this motor 110 functions as a palm rest for a left hand or as a grasp for the device with a left hand when the device is used for rehabilitating a left hand); a motor 111 for actuating the supports or rests 120 121 for the index finger (the casing of this motor 111 functions as a palm rest for a right hand or as a grasp for the device with a right hand when the device is used for rehabilitating a right hand); a motor 109 for actuating the support or rest 124 for the thumb; a transmission mechanism 112 (held in carriage 149) associated to motor 110; a transmission mechanism 113 (held in carriage 159) associated to motor 109; a transmission mechanism 114 (held in carriage 139) associated to motor 111; and a locking arm 115 for a thumb adjustment mechanism.

Figure 5A:
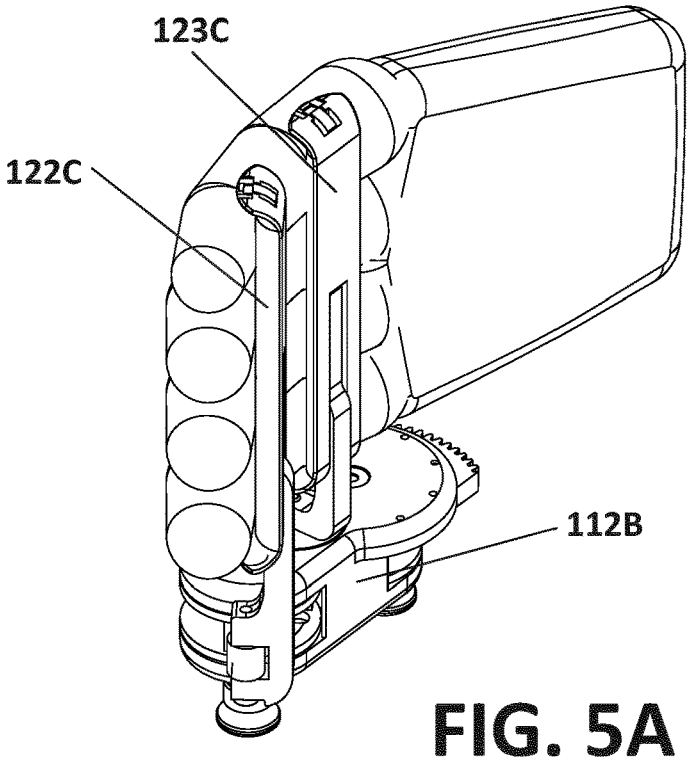
FIGS. 5A-5C show different views of a hand rehabilitation device according to an additional alternative embodiment of the disclosure.
Figure 5B:
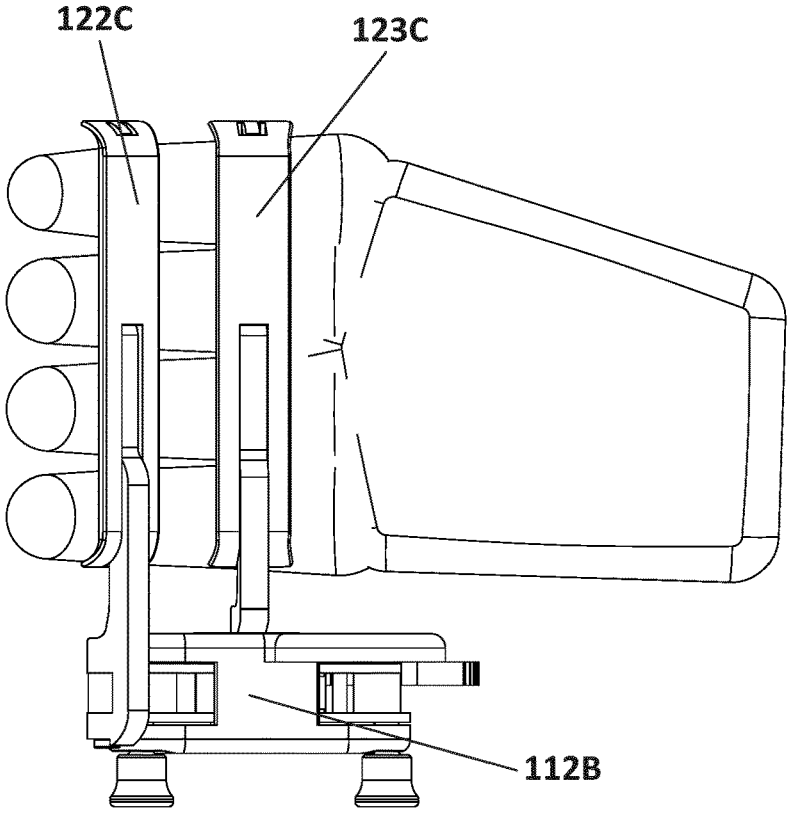
Figure 5C:
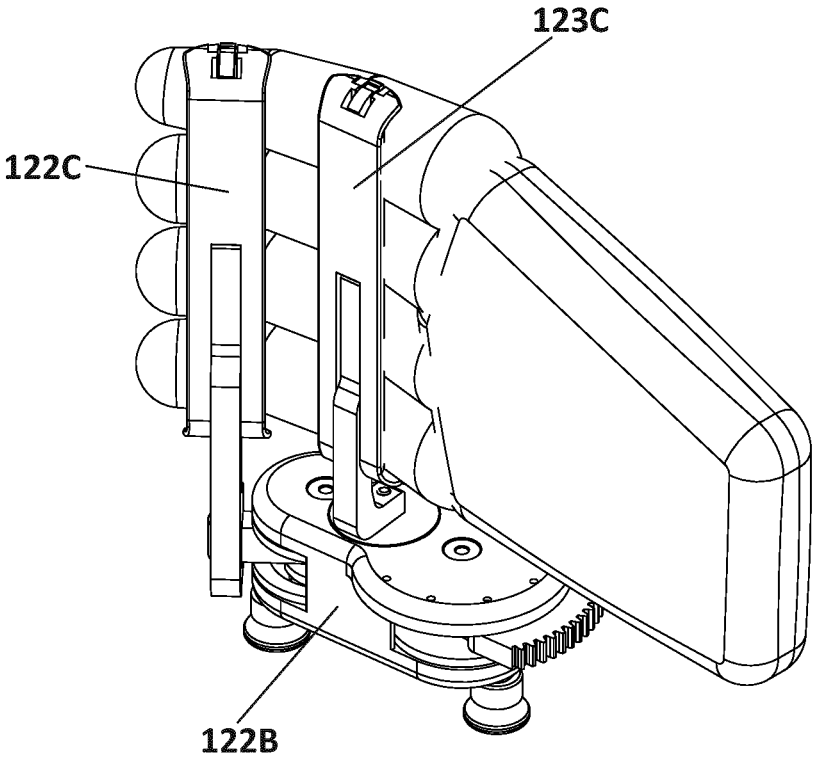

FIGS. 5A to 5C show three views of a more general embodiment, in which there is a single proximal finger rest or support 123C for the proximal phalanx and the intermediate phalanx of index, middle, ring and little fingers; and a single distal finger rest or support 122C for the distal phalanx of index, middle, ring and little fingers. Thus, the device permits rehabilitation of at least the index, middle, ring and little fingers in two sections: a first section including the proximal phalanx and the intermediate phalanx of each finger; and a second section including the distal phalanx of each finger. In this case, the distal finger rest 122C ends up between the distal and the intermediate phalanx of the index, middle, ring and little fingers, while the proximal finger rest 123C ends up between the proximal and the intermediate phalanx of the index, middle, ring and little fingers. With this double movement (movement in two sections) the flexion/extension of each finger is performed in a natural way, without forcing the joints. In these views the thumb and corresponding rehabilitation mechanism have been removed for clarity purposes. In a most preferred embodiment, shown in FIGS. 1-3C, apart from this two-section rehabilitation, there is independent rehabilitation of the index finger with respect to the group formed by the middle, ring and little fingers.

As will be explained later, in use of the device, the supports or finger rests 120 121 122 123 122C 123C 124 are moved, actuated by motors 110 111 109 1108 (motor 1108 is not shown, being the motor for the 4 fingers in FIGS. 5A-5C), provoking the flexion/extension of the fingers (and thumb) supported on the corresponding finger rests. As can be observed, the device 100 permits independent rehabilitation of the thumb (by means of rest 124 (see for example FIG. 3A)) and rehabilitation in two sections of the four fingers (by means of finger rests 122C 123C (FIGS. 5A-5C) or finger rests 120 121 122 123 (FIGS. 1-3C). In this particular embodiment, independent rehabilitation of the index finger, with respect to the three remaining fingers, is achieved, which are rehabilitated in a single group. Thus, in this particular embodiment, apart from rehabilitating the fingers in two sections (a first one for proximal and intermediate phalanxes and a second one for distal phalanxes), the device permits independent rehabilitation (functional flexion/extension) of thumb and index finger, these fingers being the ones involved in most types of grasping movements. The remaining fingers—middle, ring and little fingers—are simultaneously moved in a single group. The device 100 permits passive rotation of finger supports (finer rests) for self-alignment with hands of varying sizes.

Next, the transmission mechanism 112 113 114 112B (112 113 114 in FIGS. 1-3C and 112B in FIGS. 5A-5C) which enables the flexion/extension of the thumb and fingers is explained next. Each transmission mechanism 112 113 114 112B is actuated by a motor 110 109 111 110B. There is an independent transmission mechanism 113 for the thumb and at least one additional independent transmission mechanism 112B for the four fingers. In the particular embodiment in which there is independent rehabilitation of the index finger, there are two additional independent transmission mechanisms 112 114 (instead of one 112B): one independent transmission mechanism 114 for the index finger and one independent transmission mechanism 112 for the three remaining fingers. In an alternative embodiment, there is an independent transmission mechanism 113 for the thumb and one single additional independent transmission mechanism for the four fingers, even when there is an independent rest of the index. This is achieved by connecting or locking, for example by means of a bar, rest 120A with rest 122A in FIG. 4A, or rest 120B with rest 122B in FIG. 4E, or rest 120 with rest 122 and rest 121 with rest 123 in FIG. 3A. In any of these cases, one of the two motors (motor 111 or motor 110) could be removed. The functioning of the several transmission mechanisms is the same and is described next. Next, two possible embodiments for the transmission mechanism are described with reference to respective FIGS. 6 and 7. Both embodiments comprise a double gearwheel mechanism 130 131 and are equivalent within the range of motion (ROM) of interest. FIGS. 9A-9F show several positions of the mechanism of the flexion/extension of the fingers (in this case implemented as shown in FIG. 7).

FIGS. 6 and 7 show two possible embodiments of the double gearwheel mechanism 130 131. The double gearwheel mechanism 130 in FIG. 6 is based on a double toothed gearwheel. The double gearwheel mechanism 131 in FIG. 7 is based on a double wheel with mechanical coupling. In both implementations 130 131 of the mechanism, a respective motor 111 110 109, not shown in FIGS. 6 and 7, actuates on a pinion 132, which is rotated by the motor. The pinion 132 in turn makes a crown 133 move (the crown 133 is shown in FIGS. 9A-9F). The crown 133 is fixed to the carriage 139 149 159, which houses inside the transmission mechanism 114 112 113 (in this embodiment, double gearwheel mechanism 130 131). In its movement (rotation), the crown 133 drags the carriage 139 149 159. Next description applies to a rehabilitating structure for the index finger, of for the 3 fingers (middle, ring and little), or for the 4 fingers (index, middle, ring and little), or for the thumb. The support for the intermediate phalanx of the fingers (intermediate support or proximal support) 121 123 123C is fixed to the carriage 139 such that the movement of the motor 111 110 1108 produces an angular displacement of the carriage 139

(by means of the rotation of the crown 133) and a corresponding angular displacement of the support 121 123 123C for the intermediate phalanx. The transmission mechanism 130 131 (double gearwheel) comprises an input wheel 135A 136A and an output wheel 135B 136B. Input wheel 135A 136A and output wheel 135B 136B are connected to each other such that the input wheel 135A 136A does not move when the carriage 139 moves (angular displacement) but produces a rotation of the output wheel 135B 136B. Additional features applicable to the particular embodiment in which each finger (index on the one hand and middle, ring and little fingers on the other hand) is rehabilitated in two sections (FIGS. 1-3C), are explained next. The following explanation fully applies to the thumb because the distal phalanx support is the same in all three modules (index, fingers, thumb). The support 120 122 122C for the distal phalanx of the finger (distal support) is fixed to the output wheel 135B 136B such that the movement of the motor 110 111 109 1108 produces an angular displacement of the carriage 139 and a corresponding angular displacement of the support 120 122 for the distal phalanx. In addition, the movement of the carriage 139 produces a rotation of the output wheel 135B 136B and that rotation produces and angular displacement of the support 120 122 for the distal phalanx with respect to the position of the carriage 139. As explained, the angular displacement of the distal phalanx support 120 122 122C is greater than the angular displacement of the intermediate phalanx support 121 123 123C.

The motor 110 111 109 1108 can be selectively activated by the user (or by a therapist) for operation of the device. In a preferred embodiment, the motor is powered by battery. Alternatively, it could be powered by conventional available electricity. For simplicity reasons, in FIGS. 6 and 7 the pinion 132 and the crown 133 are not shown because they are housed in a casing, housing or base 134. FIG. 3B clearly shows motor 109 and its pinion 162, motor 110 and its pinion 172 and motor 111 and its pinion 132.

In FIG. 6, the transmission mechanism (double gearwheel mechanism) 130 is formed by two toothed gearwheels: an input toothed gearwheel 135A and an output toothed gearwheel 135B (also referred to as gear train) engaged by respective teeth. The input toothed gearwheel 135A is mounted in the rotational axis 160 of the carriage 139 such that when the carriage rotates by the rotation of the crown 133, the input gearwheel 135A does not move. The output gearwheel 135B is mounted in the carriage 139 through its axis 180 so the output gearwheel 135B moves when the carriage 139 moves but can rotate freely in the carriage 139. As the input gearwheel 135A is engaged to the output gearwheel 136B (through a toothed edge) when the movement of the carriage 139 drags the output gearwheel 135A, the output wheel 136B is forced to rotate over the input gearwheel 136A. The proximal phalanx support 121 123 123C is fixed to the carriage 139 whilst the distal phalanx support 120 122 122C is fixed to the output gearwheel 135B. That way, the angular displacement of the lower phalanx support 121 123 123C is the displacement of the carriage 139 whilst the angular displacement of the distal phalanx support 120 122 122C is the displacement of the carriage plus the rotation of the output gearwheel 135B. The angular displacement of the distal phalanx support 120 122 122C and proximal phalanx support 121 123 123C can produce the flexion/extension of the fingers (either index finger, thumb or remaining fingers).

In FIG. 7, the transmission mechanism (double gearwheel mechanism) 131 is formed by two discs or wheels, an input wheel 136A and an output wheel 136B which do not touch directly each other and a coupling means or mechanical coupling (such as a coupling rod) 137 connecting the two discs or wheels together. The coupling means 137 is fixed to the input and output wheels 136A 136B such that the distance between the connecting points of the input and output wheels 136A 136B is fixed.

The input wheel 136A is mounted in the rotational axis 160 of the carriage 139, such that when the carriage rotates by the rotation of the crown 133, the input wheel 136A does not move. The output wheel 136B is mounted in the carriage through its axis 180. So the output wheel 136B moves when the carriage 139 moves, but can rotate freely in the carriage 139. As the input wheel 136A is engaged to the output wheel 136B (through a coupling rod 137), when the movement of the carriage 139 drags the output wheel 136B, the output wheel 136B is forced to rotate by the connecting rod 137 to maintain the distance between the connecting points of the input and output wheels 136A 136B. The proximal phalanx support 121 123 123C is fixed to the carriage 139 whilst the distal phalanx support 120 122 122C is fixed to the output wheel 136B. That way the angular displacement of the proximal phalanx support 121 123 123C is the displacement of the carriage 139, whilst the angular displacement of the distal phalanx support 120 122 122C is the displacement of the carriage plus the rotation of the output wheel 136B. The angular displacement of the distal phalanx support 120 122 122C and proximal phalanx support 121 123 123C can produce the flexion/extension of the fingers (either index finger, thumb or remaining fingers).

FIG. 8 shows a break-up of the transmission mechanism (double gearwheel mechanism) 131 in FIG. 7. A first casing, housing or base 134 houses the pinion 132 and partially the crown 133. Note that we refer generally to pinion 132 but we could refer correspondingly to pinion 162 172 (see for example FIG. 3B). This is the same as in the transmission mechanism 130 shown in FIG. 6. A second casing or carriage 139 houses the fixed wheel 136B, the moving wheel 136A and the mechanical coupling 137 (in the transmission mechanism 130 in FIG. 6, the carriage 139 houses the double toothed gearwheel). Like in the transmission mechanism (double gearwheel mechanism) 130 in FIG. 6, the crown 133 is fixed to the lower part of the carriage 139. In the shown embodiment, the input wheel 136A and the output wheel 136B are identical, and are formed by two flat discs disposed parallel to each other and fixed one another by any kind of mechanical attachment 137 (connecting rod) which establishes a fixed distance between the connecting points of the input and output wheels 136A 136B. The input wheel 136A and the carriage 139 comprise an elongated canal 141A, which defines two end positions P1 P2 for the angular displacement of the carriage 139, to control the maximum extension movement possible for the fingers. Pin 138B is used to constrain the proximal pivot point for link (mechanical attachment) 137. For a right hand configuration, the pivot point is on the left (FIG. 8 top). For a left hand configuration, the pivot point is on the right. Pin 138B has the exact function as pin 138A, that is to say, to define the position of the distal pivot point for link (mechanical attachment) 137. For a right hand configuration, the distal pivot point is on the right. For a left hand configuration, the point is on the left. Pin 138C is mounted on the carriage 139. The shaft 238C of pin 138C is housed in the elongated canal 141B so that during the angular displacement of the carriage 139, the canal 141B moves around pin 138C, but collides with the shaft 238C of the pin at the end of the stroke imposed for the carriage 139 (depending on the maximum extension movement established for the fingers). These two positions P1 P2 defined in the input wheel 136A also permit the implementation of the reversibility feature of the device. They also contribute to security, since for example they prevent damage on the user in the event a motor fails. When the device is configured to rehabilitate a left hand, pin 138C is in position P1. On the contrary, when the device needs to be reconfigured in order to rehabilitate a right hand, pin 138C is placed in position P2. The support or rest for the intermediate phalanx (121 in the case of index finger, 123 in the case of middle, ring or little fingers, 122C in the case of a single proximal support for the four fingers together) is coupled to carriage 139 by means of attaching means 141.

FIG. 8 shows the particular embodiment in which rehabilitation of the fingers is done in two sections. In order to achieve this two-section rehabilitation, the support or rest for the distal phalanx (120 in the case of index finger, 122 in the case of middle, ring or little fingers, 123C in the case of a single distal support for the four fingers together) is coupled to the output wheel 136B by means of a part 144 on which the support (120, 122, 123C) is fixed. This part 144 is connected to the output wheel 136B by means of pivoting means 142 connected in one end to part 144 (for example by means of a screw 145) and in the other end 142B to the output wheel 136B and second housing 139 (for example by means of a screw 146). This connection permits additional travel of the distal support 120 (or 122, 123C) with respect to the maximum rotation achieved by the carriage 139. The angle travelled by the distal phalanx is therefore larger than the angle travelled by the proximal phalanx. In a particular embodiment, the device is designed for the distal phalanx to travel an angle which is around twice the travel of the angle travelled by the proximal phalanx. FIG. 8 also shows the support for the proximal phalanx (121 in the case of index finger, 123 in the case of middle, ring or little fingers, 123C in the case of 4 fingers) and the part 141 on which the support is fixed. This part 141 is connected to the support. These parts 141 144 and their corresponding supports are also shown in FIG. 3C.

FIGS. 9A-9F show several positions of the mechanism of the flexion/extension of the fingers (in this case the mechanism 131 is implemented as shown in FIG. 7). These positions can refer to the index finger, or to the three other fingers, or to the four fingers together, and even to the thumb, if two-sections for the two phalanxes were implemented. FIGS. 9A-9C refer to a sequence for a right hand. FIG. 9A refers to a position with substantially maximum extension while FIG. 9C refers to a position with substantially maximum flexion. FIGS. 9D-9F refer to sequence for a left hand. FIG. 9D refers to a position with substantially maximum extension while FIG. 9F refers to a position with substantially maximum flexion. As can be observed, wheel 136A and pin 138B remain fixed with respect to the housing, casing or base 134. The carriage 139 rotates actioned by crown 133 in turn actioned by the pinion 162 (or 132 172) moved by a motor (not shown). The crown 133 drags carriage 139 and in turn the mechanical coupling 137 moves the output wheel 136B.

FIGS. 10A-10F show several positions of the mechanism of the flexion/extension of the index finger (right hand in FIGS. 10A-10C and left hand in FIGS. 10D-10F).

FIGS. 11A-11D show different views of the hand rehabilitation device shown for example in FIG. 1, but in this case configured to rehabilitate a left hand, which is illustrated in its functional position for rehabilitation. In this figures, the casings of the transmission mechanism for the index finger has been erased, in order to show the functioning of the double gearwheel mechanism 131. The transmission mechanism 112 for the group of middle, ring and little fingers works in a similar way. The transmission mechanism 112C for the group of index, middle, ring and little fingers works in a similar way. In FIG. 11B the casing 151 in which the motor 110 which actuates the transmission mechanism 112 for the group of middle, ring and little fingers is shown. It is remarked that the location of the motors may vary in different designs of the device. Reference 152 is the casing in which motor 111 is housed. The casing that houses the transmission mechanism 114 for the index has been erased, in order to show the transmission mechanism 114. The transmission mechanism 112 for the three fingers is also shown (in this case hidden by its casing). The thumb has been erased from these views for clarity purposes. FIGS. 12A-12D show different views of the same hand rehabilitation device, in this case configured to rehabilitate a right hand. Again, the thumb has been erased from these views for clarity purposes.

As already mentioned, the device is reversible. This means that the same device can be used to rehabilitate both a right hand and a left hand. The transmission mechanism illustrated in FIG. 6 does not require any reconfiguration in order to switch from a "right hand configuration" to a "left hand configuration" or vice versa. That is to say, reversibility is automatic. FIGS. 13A-13D illustrate the reversibility capability of the transmission mechanism of FIG. 7. Since there are 3 transmission mechanisms in one device (index finger, 3 fingers and thumb), the reconfiguration must be done three times, because each finger requires reorienting wheels 136A and 136B and lock with pins 138B and 138C. That is to say, in order to perform reconfiguration, the pins 138B 138C must be lifted, then wheels must be turned, so that the pin naturally locks into position in the opposite end of the circular groove (canal) with the round holes in the ends. Alternatively, pins 138B 138C could be one single mechanism in order to simplify the process. Additionally, the thumb lock mechanism also needs to be reconfigured. Turning back to FIG. 8, during reconfiguration, the set formed by support 120 (or 122) and part 144 moves freely with respect to screw 145. Similarly, the set formed by support 121 (or 123) and part 141 moves freely with respect to corresponding screw (both if the transmission mechanism in FIG. 6 and in that in FIG. 7).

FIGS. 13A and 13C show the left hand configuration, while FIGS. 13B and 13D show the corresponding right hand reconfiguration. In the reconfiguration process from left to right hand (it would be similar from right to left hand), the housing or base does not change position. Pin 138B, which in left-hand configuration is positioned in position P2 (see FIG. 8) in output wheel 136B is moved to position P1 (see FIG. 8). The mechanical coupling (transmission bar) 137 becomes naturally re-oriented when the wheels 136A 136B change position. Pin 138B also changes position from position P2' (left hand configuration) to position P1' (right hand configuration). Pivoting axis 160 is maintained in both left-hand and right-hand configurations, independently from the positions of motors. The second casing, housing or carriage 139 pivots or rotates around this pivoting axis 160. Pin 138A does not have any influence in reconfiguration. As already mentioned, the transmission mechanism shown in FIG. 6 does not need any change in order to be reconfigured, except for the free movement of the set formed by support 120 (or 122) and part 144 and the free movement of the set formed by support 121 (or 123) and part 141. In both mechanisms, it is possible to add safety pins in order to prevent over-travel of the hand in the event of failure of a motor.

The device 100 permits two symmetrical grasp modes supported for each of left-hand and right-hand operation: cylindrical mode (for grasping for example a glass) and "open pinch/clamp" for 3-fingered grasp (predominantly MCP action).

In conclusion, a simple, portable, hand-held device for rehabilitation has been provided. The device permits independent rehabilitation (flexion/extension) of the thumb and independent rehabilitation (flexion/extension) of the index finger with respect to the remaining fingers (middle, ring and little fingers), which are rehabilitated in a group. What is more, the device permits rehabilitation of the fingers in two flexion/extension sections: a first one for the proximal and intermediate phalanxes and a second one of the distal phalanxes. This double-section rehabilitation permits to open a finger in a natural way, without forcing its joints. Finally, the device is reversible, meaning that with a simple reconfiguration that can be done by the user or by a therapist, the very same device can be used to rehabilitate an impaired right hand and an impaired left hand.

On the other hand, the disclosure is obviously not limited to the specific embodiment(s) described herein, but also encompasses any variations that may be considered by any person skilled in the art (for example, as regards the choice of materials, dimensions, components, configuration, etc.), within the general scope of the disclosure as defined in the claims.

The invention claimed is:

1. A hand rehabilitation device to be grasped by a hand to be trained, wherein in use of the hand rehabilitation device, the palm, fingers, and thumb of said hand to be trained surround the hand rehabilitation device, comprising:

at least one first support configured to support the thumb of a hand, wherein said at least one first support is designed to perform flexion and extension movements for rehabilitating said thumb, said flexion and extension movements being actioned by a first transmission mechanism to which the at least one first support is connected;

at least one second support configured to support the index finger of said hand, wherein said at least one second support is designed to perform flexion and extension movements for rehabilitating said index finger, said flexion and extension movements being actioned by a second transmission mechanism to which the at least one second support is connected;

at least one third support configured to support the three remaining fingers of said hand, wherein said at least one third support is designed to perform flexion and extension movements for rehabilitating said three remaining fingers, said flexion and extension movements being actioned by a third transmission mechanism to which the at least one third support is connected;

wherein said first transmission mechanism is actuated by one motor and said second transmission mechanism and said third transmission mechanism are actuated by at least two motors, the one motor actuating said first transmission mechanism being different from the at least two motors configured to actuate said second and third transmission mechanisms; and wherein the three flexion and extension movements of said at least one first support, said at least one second support and said at least one third support are independent from each other; and wherein the device includes a reversible means configured to adjust the device between a right hand configuration and a left hand configuration.

2. The hand rehabilitation device of claim 1, wherein at least one of said first, second and third transmission mechanisms comprises a pinion and a crown configured to move actioned by said pinion, which in turn is configured to rotate actioned by the motor actioning the respective first, second, and third transmission mechanism.

3. The hand rehabilitation device of claim 2, wherein upon rotation, said crown is configured to pull two crown gears interconnected by respective protrusions or teeth, causing said at least one first support, at least one second support, and at least one third support to provide the flexion and extension movements.

4. The hand rehabilitation device of claim 2, wherein upon rotation, said crown is configured to pull an assembly formed by two wheels and coupling means connecting said two wheels together, wherein the wheel closest to the pinion is fixed and the other wheel and the coupling means move as a result of the movement of the crown.

5. The hand rehabilitation device of claim 1, wherein said at least one second support comprises a single support for the index finger and said at least one third support comprises a single support for the three remaining fingers.

6. The hand rehabilitation device of claim 1, wherein said at least one second support comprises one distal support for the distal phalanx of the index finger and one proximal support for the intermediate phalanx of the index finger, and said at least one third support comprises one distal support for the distal phalanx of the three remaining fingers and one proximal support for the intermediate phalanx of the three remaining fingers.

7. The hand rehabilitation device of claim 1, the device being reversible by performing the following for each one of the first, second, and third transmission mechanisms:

either by moving freely with respect to a pivoting means a set formed by the at least one second support or the at least one third support, and a part, when at least one of the first, second, and third transmission mechanisms comprises two crown gears interconnected by respective protrusions or teeth;

or, when at least one of the first, second, and third transmission mechanisms comprises two wheels and coupling means connecting said two wheels together, by lifting a first pin and a second pins and turning the wheels until the corresponding pin locks into a position in an end of a canal and by moving freely with respect to the pivoting means a set formed by the at least one second support or the at least one third support, and a part.

8. A hand rehabilitation device to be grasped by a hand to be trained, wherein in use of the hand rehabilitation device, the palm, fingers, and thumb of said hand to be trained surround the hand rehabilitation device, comprising:

at least one first support configured to support the thumb of a hand, wherein said at least one first support is designed to perform flexion and extension movements for rehabilitating said thumb, said flexion and extension movements being actioned by a first transmission mechanism to which the at least one first support is connected;

at least one proximal support configured to support the intermediate phalanx of at least the middle, ring, and little fingers of said hand, wherein said at least one proximal support is designed to perform flexion and extension movements of said intermediate phalanxes of said fingers, actioned by at least one second transmission mechanism to which the at least one proximal support is connected;

at least one distal support configured to support the distal phalanx of at least the middle, ring, and little fingers of said hand, wherein said at least one distal support is designed to perform an additional flexion and extension movements of said distal phalanxes of said fingers with respect to the flexion and extension movements of said intermediate phalanxes of said fingers, actioned by said at least one second transmission mechanism to which the at least one distal support is connected;

wherein said first transmission mechanism is actuated by one motor and said second transmission mechanism is actuated by at least one motor, the motor actuating said first transmission mechanism being different from the motor configured to actuate said second transmission mechanism;

wherein the flexion and extension movements of said at least one first support is independent from the flexion and extension movements of said at least one proximal support and at least one distal support; and wherein the device includes a reversible means configured to adjust the device between a right hand configuration and a left hand configuration.

9. The hand rehabilitation device of claim 8, wherein at least one of said first and second transmission mechanisms comprises a pinion and a crown configured to move actioned by said pinion, which in turn is configured to rotate actioned by the motor actioning the respective first and second transmission mechanism.

10. The hand rehabilitation device of claim 9, wherein upon rotation, said crown is configured to pull two crown gears interconnected by respective protrusions or teeth, causing said at least one first support, at least one proximal support, and at least one distal support to provide the flexion and extension movements.

11. The hand rehabilitation device of claim 9, wherein upon rotation, said crown is configured to pull an assembly formed by two wheels and coupling means connecting said two wheels together, wherein the wheel closest to the pinion is fixed and the other wheel and the coupling means move as a result of the movement of the crown.

12. The hand rehabilitation device of claim 8, wherein said at least one proximal support comprises a single support for the intermediate phalanxes of said index, middle, ring and little fingers and said at least one distal support comprises a single support for the distal phalanxes of said index, middle, ring and little fingers.

13. The hand rehabilitation device of claim 8, wherein said at least one proximal support comprises a first support for the intermediate phalanx of said index finger and a second support for the intermediate phalanx of said middle, ring and little fingers; and said at least one distal support comprises a third support for the distal phalanx of said index finger and a fourth support for the distal phalanxes of said middle, ring, and little fingers.

14. The hand rehabilitation device of claim 13, wherein the at least one second transmission mechanism is configured for actuating said first support for the intermediate phalanx of the index finger and said third support for the distal phalanx of the index finger and the at least third transmission mechanism is configured for actuating said second support for the intermediate phalanx of the middle, ring, and little fingers and said fourth support for the distal phalanx of the middle, ring, and little fingers.

15. The hand rehabilitation device of claim 8, the device being reversible by performing the following for each one of the first transmission mechanism and the second transmission mechanism:

either by moving freely with respect to a pivoting means a set formed by the at least one proximal support or the at least one distal support, and a part, when the transmission mechanism comprises two crown gears interconnected by respective protrusions or teeth;

or, wherein at least one of the first, second, and third transmission mechanisms comprises two wheels and coupling means connecting said two wheels together, by lifting a first pin and a second pin and turning the wheels until the corresponding pin locks into a position in an end of a canal and by moving freely with respect to the pivoting means a set formed by the at least one proximal support or the at least one distal support and a part.

* * * * *